US010660485B2

(12) United States Patent
Johnson et al.

(10) Patent No.: US 10,660,485 B2
(45) Date of Patent: May 26, 2020

(54) DUAL ROLL PRODUCT DISPENSER WITH ROTATING REFILL CARRIAGE

(71) Applicant: GPCP IP Holdings LLC, Atlanta, GA (US)

(72) Inventors: Alan Joseph Johnson, Kaukauna, WI (US); Brian Scott Borke, Appleton, WI (US); John Patrick Laitala, Appleton, WI (US); Nickolas Everett Madsen, Atlanta, GA (US); Paul James Ruthven, Neenah, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 283 days.

(21) Appl. No.: 15/727,875

(22) Filed: Oct. 9, 2017

(65) Prior Publication Data

US 2019/0104895 A1 Apr. 11, 2019

(51) Int. Cl.
*A47K 10/36* (2006.01)

(52) U.S. Cl.
CPC .. *A47K 10/3687* (2013.01); *A47K 2010/3681* (2013.01)

(58) Field of Classification Search
CPC ..... A47K 10/3687; A47K 2010/3681
See application file for complete search history.

(56) References Cited

U.S. PATENT DOCUMENTS 2,193,759 A 3/1940 Birr
2,919,842 A 1/1960 Batlas
4,552,315 A 11/1985 Granger
5,244,161 A 9/1993 Wirtz-Odenthal
5,257,711 A 11/1993 Wirtz-Odenthal
5,271,574 A 12/1993 Formon et al.
5,441,189 A 8/1995 Formon et al.
5,511,743 A 4/1996 Kozlowsky et al.
5,538,587 A 7/1996 Sakano et al.
5,558,302 A 9/1996 Jesperson
5,915,645 A 6/1999 Granger
5,974,764 A 11/1999 Anstey et al.
(Continued)

FOREIGN PATENT DOCUMENTS

WO WO 2013059127 A2 4/2013

*Primary Examiner* — William A. Rivera
(74) *Attorney, Agent, or Firm* — Nelson Mullins Riley & Scarborough LLP

(57) ABSTRACT

Systems, methods, and apparatuses regarding an improved sheet product dispenser are provided herein. Example sheet product dispensers include a rotatable carriage that holds two full size product rolls. Upon substantial depletion of one of the product rolls, the sheet product dispenser is configured to enable the carriage to rotate to present the depleted product roll to the janitor for easy and intuitive replacement. For example, a carriage with a depleted product roll may be configured to automatically rotate upon opening of the cover. Additional features for intuitive and reliable installation of the product roll are also provided herein, such as roll holder slot guides and a retention mechanism that maintains installation of a product roll during rotation of the carriage. Such example sheet product dispensers help to eliminate product waste, reduce confusion while loading, and reduce the time and effort required to load the sheet product dispenser.

25 Claims, 20 Drawing Sheets

(56) References Cited

U.S. PATENT DOCUMENTS 6,152,397 A 11/2000 Purcell
6,196,102 B1 * 3/2001 Granger ..... A47K 10/3643 83/335
6,363,824 B1 4/2002 Granger
6,592,067 B2 7/2003 Denen et al.
6,838,887 B2 1/2005 Denen et al.
6,871,815 B2 3/2005 Moody et al.
7,182,288 B2 * 2/2007 Denen ..... A47K 10/3687 242/560
7,270,292 B2 9/2007 Rasmussen
7,568,652 B2 * 8/2009 Cittadino ..... A47K 10/3687 242/560.2
7,698,980 B2 4/2010 Morris et al.
7,821,155 B2 10/2010 Reinsel et al.
7,845,593 B2 12/2010 Formon et al.
7,866,593 B2 1/2011 Friesen et al.
7,878,444 B2 2/2011 Friesen et al.
7,878,445 B2 2/2011 Granger et al.
7,913,945 B2 3/2011 Friesen et al.
7,984,872 B2 7/2011 Kuehneman et al.
8,066,217 B2 11/2011 Cittadino et al.
8,162,252 B2 4/2012 Cittadino et al.
8,186,551 B2 5/2012 Morris et al.
8,381,329 B2 2/2013 Bayley et al.
8,382,026 B2 2/2013 Keily et al.
8,496,198 B2 7/2013 Cittadino et al.
8,511,599 B2 8/2013 Lalau et al.
8,708,270 B2 4/2014 Cittadino et al.
8,882,021 B2 11/2014 Cittadino et al.
8,919,688 B2 12/2014 Kuehneman et al.
9,027,871 B2 5/2015 Kuehneman et al.
9,144,352 B2 9/2015 Cittadino et al.
9,328,490 B2 5/2016 Bayley et al.
9,345,367 B2 5/2016 Keily et al.
2008/0018302 A1 1/2008 Reinsel et al.
2008/0087758 A1 4/2008 Formon et al.
2008/0087759 A1 * 4/2008 Cittadino ..... A47K 10/3687 242/598.4
2008/0109956 A1 5/2008 Bayley et al.
2008/0128448 A1 6/2008 Cittadino et al.
2009/0101751 A1 4/2009 Cittadino et al.
2009/0266926 A1 10/2009 Yoshimaru et al.
2009/0266928 A1 10/2009 Friesen et al.
2009/0266929 A1 10/2009 Friesen et al.
2009/0266930 A1 10/2009 Friesen et al.
2009/0314875 A1 12/2009 Granger et al.
2010/0089939 A1 4/2010 Morris et al.
2010/0301157 A1 12/2010 Keily et al.
2011/0139920 A1 * 6/2011 Formon ..... A47K 10/3836 242/559.2
2011/0215188 A1 9/2011 Lalau et al.
2011/0253829 A1 * 10/2011 Goeking ..... A47K 10/26 242/560.1
2014/0110522 A1 4/2014 Goeking et al.

* cited by examiner

DUAL ROLL PRODUCT DISPENSER WITH ROTATING REFILL CARRIAGE

FIELD

Embodiments of the present invention relate to sheet product dispensers and, more particularly, to dual roll sheet product dispensers.

BACKGROUND

Sheet product dispensers, such as paper towel dispensers or tissue dispensers, provide on-demand sheet product to a user from a supply of sheet product stored within the dispenser, such as in roll form. The sheet product is dispensed from the roll by passing one end of the sheet product through a pair of rollers. Depending on the type of dispenser, dispensing may be accomplished automatically (e.g., with a motor) or manually (e.g., using the force a user applies).

Due to the compact nature of sheet product dispensers, it is difficult to provide a large, long standing supply of paper towels. Thus, janitors or other maintenance personnel are often required to replace empty paper towels. The variable nature of use, however, makes it difficult for a janitor to predict when a replacement will be needed. Moreover, schedule demands of a janitor and the desire to avoid wasting paper left on a roll leads to the situation where the janitor may be unsure whether or not to replace a towel roll. In this regard, the situation of having no paper towels in the dispenser (a completely empty scenario) may arise. Alternatively, the situation of discarding a roll with remaining paper may arise. Further, janitors or other maintenance personnel may be unfamiliar with the loading process of various sheet product dispensers, leading to improper loading or increased time to load the sheet product dispenser.

SUMMARY OF THE INVENTION

In light of the foregoing background, embodiments of the present invention provide example sheet product dispensers that help to eliminate product waste, reduce confusion while loading, and reduce the time and effort required to load the sheet product dispenser. In this regard, example sheet product dispensers include a rotatable carriage that holds two full size product rolls. Upon substantial depletion of one of the product rolls, the sheet product dispenser is configured to enable the carriage to rotate to present the depleted product roll to the janitor for easy and intuitive replacement. For example, the sheet product dispenser may be designed such that the carriage with a depleted product roll is configured to automatically rotate upon opening of the cover. Additional features for intuitive and reliable installation of the product roll are also provided herein.

An example embodiment of the present invention includes a product dispenser. The product dispenser comprises a housing including a base portion and a cover. The cover is movable relative to the base portion to define an open position and a closed position. The product dispenser further includes a carriage rotatably coupled to the base portion. The carriage defines a first end and a second end. The carriage is rotatable between at least a first orientation and a second orientation. The carriage comprises a first roll holder positioned proximate to the first end of the carriage. The first roll holder is configured to receive a first roll of product. The carriage comprises a second roll holder positioned proximate to the second end of the carriage. The second roll holder is configured to receive a second roll of product. The product dispenser further comprises a dispensing mechanism configured to receive a leading edge of one of the first roll of product or the second roll of product and cause dispensing of a portion of the corresponding first roll of product or the second roll of product. In an instance in which the second roll of product is at least substantially depleted, the carriage is configured to automatically rotate to the second orientation so as to provide a user access to the second roll holder to enable replacement of the at least substantially depleted second roll of product.

In some embodiments, the product dispenser further comprises a product sensor configured to sense product data corresponding to at least one of (i) dispensing from at least one of the first roll of product or the second roll of product, or (ii) an amount of product remaining for at least one of the first roll of product or the second roll of product. The product dispenser further comprises a controller configured to determine, based on the product data from the product sensor, an instance in which the second roll of product is at least substantially depleted. The controller is further configured to enable rotation of the carriage in an instance in which the second roll of product is at least substantially depleted.

In some embodiments, the controller is further configured to, in response to determining an instance in which the second roll of product is at least substantially depleted, cause rotation of the carriage to an intermediate orientation between the first orientation and second orientation.

In some embodiments, the carriage is biased to rotate from the intermediate orientation to the second orientation. The cover may comprise at least one cover stop that is configured to interact with at least a portion of the carriage when the cover is in the closed position and the carriage has rotated to the intermediate orientation. The cover stop may prevent further rotation of the carriage toward the second orientation. In an instance in which a user opens the cover, the cover stop is removed from interaction with the portion of the carriage to cause the carriage to automatically rotate to the second orientation.

In some embodiments, the carriage comprises a first stop positioned proximate the first end and a second stop positioned proximate the second end. The product dispenser may further comprise a release stop that is configured to interact with the second stop of the carriage when the carriage is in the first orientation. The controller may be configured to, in response to determining an instance in which the second roll of product is at least substantially depleted, cause the release stop to be removed from interaction with the second stop of the carriage to cause rotation of the carriage to the intermediate orientation. The first stop of the carriage may be configured to interact with the cover stop when the carriage is in the intermediate orientation.

In some embodiments, the product dispenser may further comprise a linkage that defines a release stop and is connected to a transfer mechanism. The release stop is configured to interact with at least a portion of the carriage to prevent rotation of the carriage from the first orientation to the intermediate orientation. The transfer mechanism is configured to transfer the leading edge of the first roll of product to the dispensing mechanism to enable dispensing from the first roll of product. The controller is configured to, in response to determining an instance in which the second roll of product is at least substantially depleted, simultaneously cause, via movement of the linkage, the release stop to be removed from interaction with the portion of the carriage to cause rotation of the carriage to the intermediate orientation and the transfer mechanism to transfer the leading edge of the first roll of product to the dispensing mechanism.

In some embodiments, the product dispenser may further comprise a transfer mechanism. The transfer mechanism is configured to transfer the leading edge of the first roll of product to the dispensing mechanism to enable dispensing from the first roll of product. The transfer mechanism defines a backplate that includes visual instructions for attaching a leading edge of a roll of product to the transfer mechanism.

In some embodiments, the product dispenser may further comprise a transfer mechanism defining an extension portion. The transfer mechanism is configured to transfer the leading edge of the first roll of product to the dispensing mechanism to enable dispensing from the first roll of product. The controller is configured to, in response to determining an instance in which the second roll of product is at least substantially depleted, simultaneously cause the transfer mechanism to transfer the leading edge of the first roll of product to the dispensing mechanism and the extension portion to engage the carriage to cause rotation of the carriage from the first orientation to the intermediate orientation.

In some embodiments, the carriage is biased by at least one of gravity or one or more biasing elements to rotate from the first orientation to the second orientation.

In some embodiments, the cover defines a pull flange that is configured to pull at least a portion of the carriage as the cover opens to cause rotation of the carriage.

In some embodiments, the product dispenser may further comprise at least one motor configured to cause rotation of the carriage. The controller is configured to, in an instance in which the carriage is in the first orientation and the second roll of product is at least substantially depleted, cause the motor to automatically rotate the carriage when the cover is moved to an open position.

In some embodiments, the cover is in the closed position, the housing and the carriage are each sized such that both of the first roll holder and the second roll holder are configured to each hold a full size roll of product.

In some embodiments, the second roll holder defines a bowl shape section that corresponds to the shape of the new roll of product to enable intuitive installation of the new roll of product.

In some embodiments, the second roll holder defines a roll holder slot, wherein the roll holder slot is shaped to enable a user to drop a new roll of product into the roll holder slot for easy installation of the new roll of product.

In some embodiments, the roll holder slot of the second roll holder includes one or more installation guides to provide instruction to the user regarding how to install the new roll of product into the second roll holder.

In some embodiments, the carriage defines an axis of rotation and comprises a stationary gear with a center aligned with the axis of rotation of the carriage. The carriage also comprises a planetary gear that interacts with and rotates around the stationary gear as the carriage rotates, wherein the planetary gear includes a planetary gear center axis that is disposed outwardly from the axis of rotation of the carriage. The carriage also comprises a roll holder gear that interacts with the planetary gear as the carriage rotates, wherein the roll holder gear includes a roll holder gear center axis that is disposed outwardly from the planetary gear center axis with respect to the axis of rotation of the carriage. The roll holder gear center axis is aligned with an axis of rotation for the second roll holder. As the carriage rotates from the second orientation to the first orientation, the roll holder slot for the second roll holder remains oriented generally vertically to prevent the roll of product in the second roll holder from dropping out of the second roll holder.

In some embodiments, when the carriage is in an intermediate orientation between the first orientation and the second orientation and the second roll of product is at least substantially depleted, the carriage is configured to automatically rotate to the second orientation upon moving the cover from the closed position toward the open position.

In some embodiments, when the carriage is in the first orientation, the first roll holder is positioned generally vertically above the second roll holder, wherein, when the carriage is in the second orientation, the second roll holder is positioned generally vertically above the first roll holder.

In another example embodiment, a method of operating a product dispenser is provided. The method comprises operating a dispensing mechanism of the product dispenser to cause dispensing of a portion of at least one of a first roll of product or a second roll of product stored in the product dispenser. The product dispenser comprises a housing including a base portion and a cover. The cover is movable relative to the base portion to define an open position and a closed position. The product dispenser includes a carriage rotatably coupled to the base portion. The carriage defines a first end and a second end and is rotatable between at least a first orientation and a second orientation. The carriage comprises a first roll holder positioned proximate to the first end of the carriage. The first roll holder is configured to receive the first roll of product. The carriage includes a second roll holder positioned proximate to the second end of the carriage. The second roll holder is configured to receive the second roll of product. The dispensing mechanism is configured to receive a leading edge of one of the first roll of product or the second roll of product and cause dispensing of a portion of the corresponding first roll of product or the second roll of product. The product dispenser includes a product sensor configured to sense product data corresponding to at least one of the first roll of product or the second roll of product. The product dispenser includes a controller. The method further comprises determining, based on the product data from the product sensor, an instance in which the second roll of product is at least substantially depleted. The method further includes causing automatic rotation of the carriage to one of the second orientation or an intermediate orientation between the first orientation and the second orientation upon determining that the second roll of product is at least substantially depleted.

In some embodiments, the method further comprises causing, in an instance in which the carriage is in the first orientation and the second roll of product is determined to be at least substantially depleted, rotation of the carriage from the first orientation to an intermediate orientation between the first orientation and the second orientation.

In some embodiments, the product dispenser further comprises a linkage that defines a release stop and is connected to a transfer mechanism. The release stop is configured to interact with at least a portion of the carriage to prevent rotation of the carriage from the first orientation to the intermediate orientation. The transfer mechanism is configured to transfer the leading edge of the first roll of product to the dispensing mechanism to enable dispensing from the first roll of product. The method further comprises simultaneously causing, in response to determining an instance in which the second roll of product is at least substantially depleted and via movement of the linkage, the release stop to be removed from interaction with the portion of the carriage to cause rotation of the carriage to the intermediate orientation and the transfer mechanism to transfer the leading edge of the first roll of product to the dispensing mechanism.

In yet another example embodiment, a product dispenser is provided. The product dispenser comprises a housing including a base portion and a cover. The cover is movable relative to the base portion to define an open position and a closed position. The product dispenser includes a carriage rotatably coupled to the base portion. The carriage defines a first end and a second end and is rotatable between at least a first orientation and a second orientation. The carriage comprises a first roll holder positioned proximate to the first end of the carriage. The first roll holder is configured to receive a first roll of product. The carriage further includes a second roll holder positioned proximate to the second end of the carriage. The second roll holder is configured to receive a second roll of product. The product dispenser further includes a dispensing mechanism configured to receive a leading edge of one of the first roll of product or the second roll of product and cause dispensing of a portion of the corresponding first roll of product or the second roll of product. The product dispenser further includes a product sensor configured to sense product data corresponding to at least one of the first roll of product or the second roll of product. The product dispenser further includes a controller configured to determine, based on the product data from the product sensor, an instance in which the second roll of product is at least substantially depleted. The controller is further configured to cause, in an instance in which the carriage is in the first orientation and the second roll of product is determined to be at least substantially depleted, rotation of the carriage from the first orientation to an intermediate orientation between the first orientation and the second orientation. In an instance in which the carriage is in the intermediate orientation, the carriage is configured to automatically rotate from the intermediate orientation to the second orientation upon moving the cover from the closed position toward the open position so as to provide a user access to the second roll holder to enable replacement of the at least substantially depleted second roll of product.

In yet another embodiment, a product dispenser is provided. The product dispenser comprises a housing including a base portion and a cover. The cover is movable relative to the base portion to define an open position and a closed position. The product dispenser comprises a carriage rotatably coupled to the base portion. The carriage defines a first end and a second end and is rotatable between at least a first orientation and a second orientation. The carriage comprises a first roll holder positioned proximate to the first end of the carriage. The first roll holder is configured to receive a first roll of product. The carriage comprises a second roll holder positioned proximate to the second end of the carriage. The second roll holder is configured to receive a second roll of product. The product dispenser comprises a dispensing mechanism configured to receive a leading edge of one of the first roll of product or the second roll of product and cause dispensing of a portion of the corresponding first roll of product or the second roll of product. The product dispenser comprises a sensor configured to sense that the second roll of product is at least substantially depleted. In an instance in which the second roll of product is at least substantially depleted, the dispenser is configured to enable rotation of the carriage to the second orientation so as to provide a user access to the second roll holder to enable replacement of the at least substantially depleted second roll of product.

In some embodiments, the sensor comprises a product sensor configured to sense product data corresponding to at least one of dispensing from at least one of the first roll of product or the second roll of product or an amount of product remaining for at least one of the first roll of product or the second roll of product. The product dispenser further comprises a controller configured to determine, based on the product data from the product sensor, an instance in which the second roll of product is at least substantially depleted. The controller is further configured to enable rotation of the carriage in an instance in which the second roll of product is at least substantially depleted.

In some embodiments, the product dispenser further comprises a linkage that defines a release stop and is connected to a transfer mechanism. The release stop is configured to interact with at least a portion of the carriage to prevent rotation of the carriage. The transfer mechanism is configured to transfer the leading edge of the first roll of product to the dispensing mechanism to enable dispensing from the first roll of product. The controller is configured to, in response to determining an instance in which the second roll of product is at least substantially depleted, simultaneously cause, via movement of the linkage, the release stop to be removed from interaction with the portion of the carriage to enable rotation of the carriage and cause the transfer mechanism to transfer the leading edge of the first roll of product to the dispensing mechanism.

BRIEF DESCRIPTION OF THE SEVERAL VIEWS OF THE DRAWINGS

Figure 1:
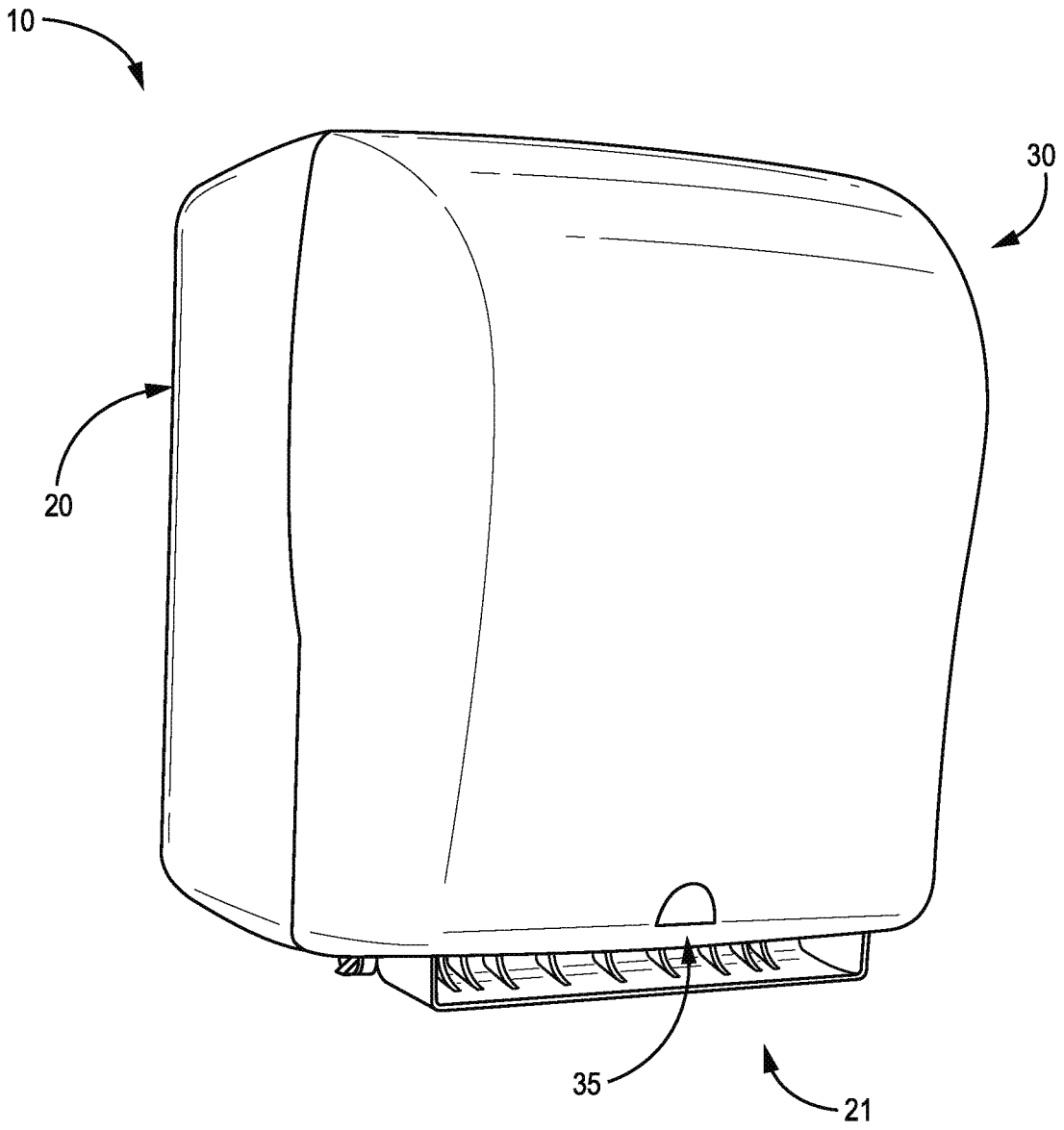
Figure 2:
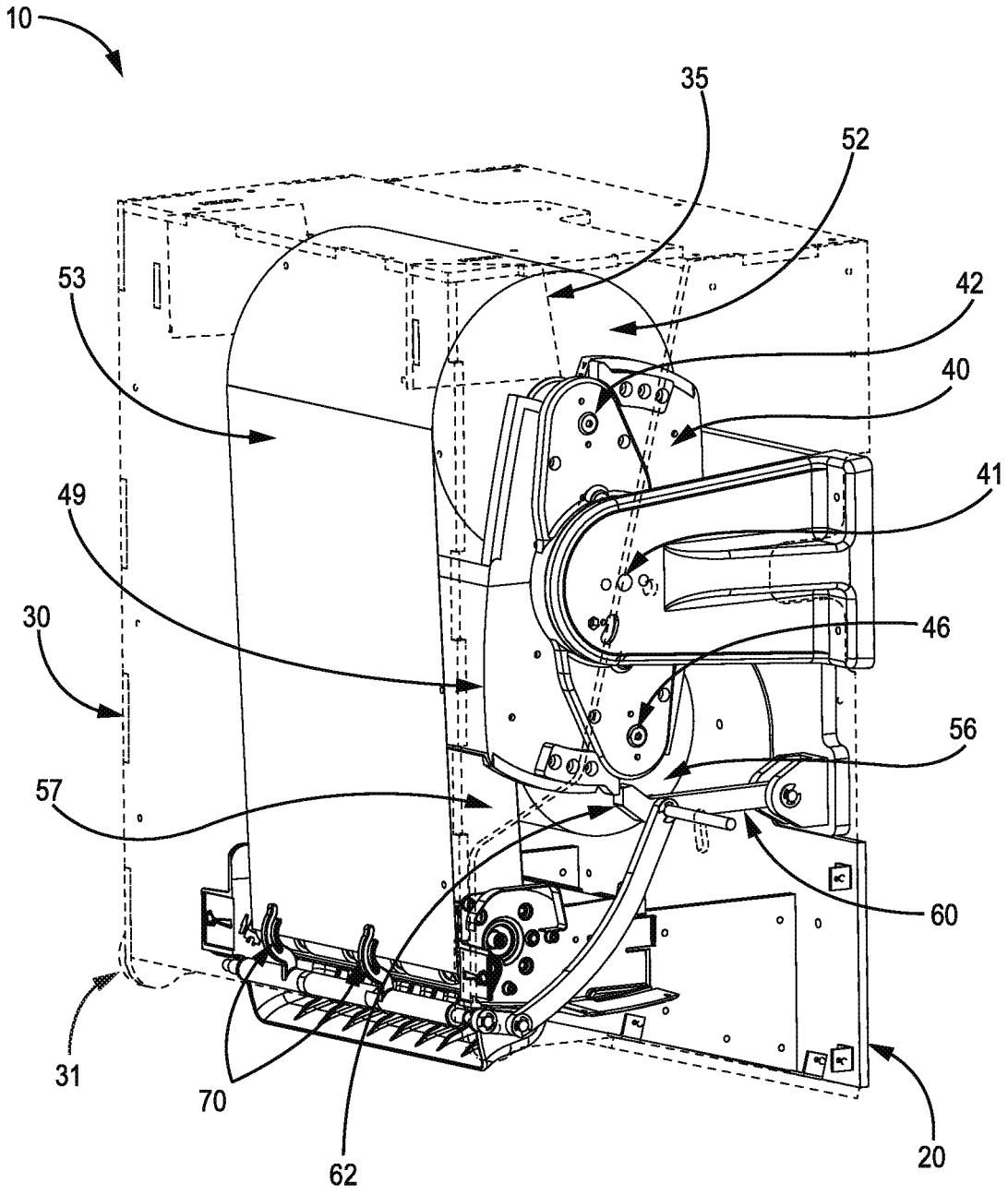
Figure 3:
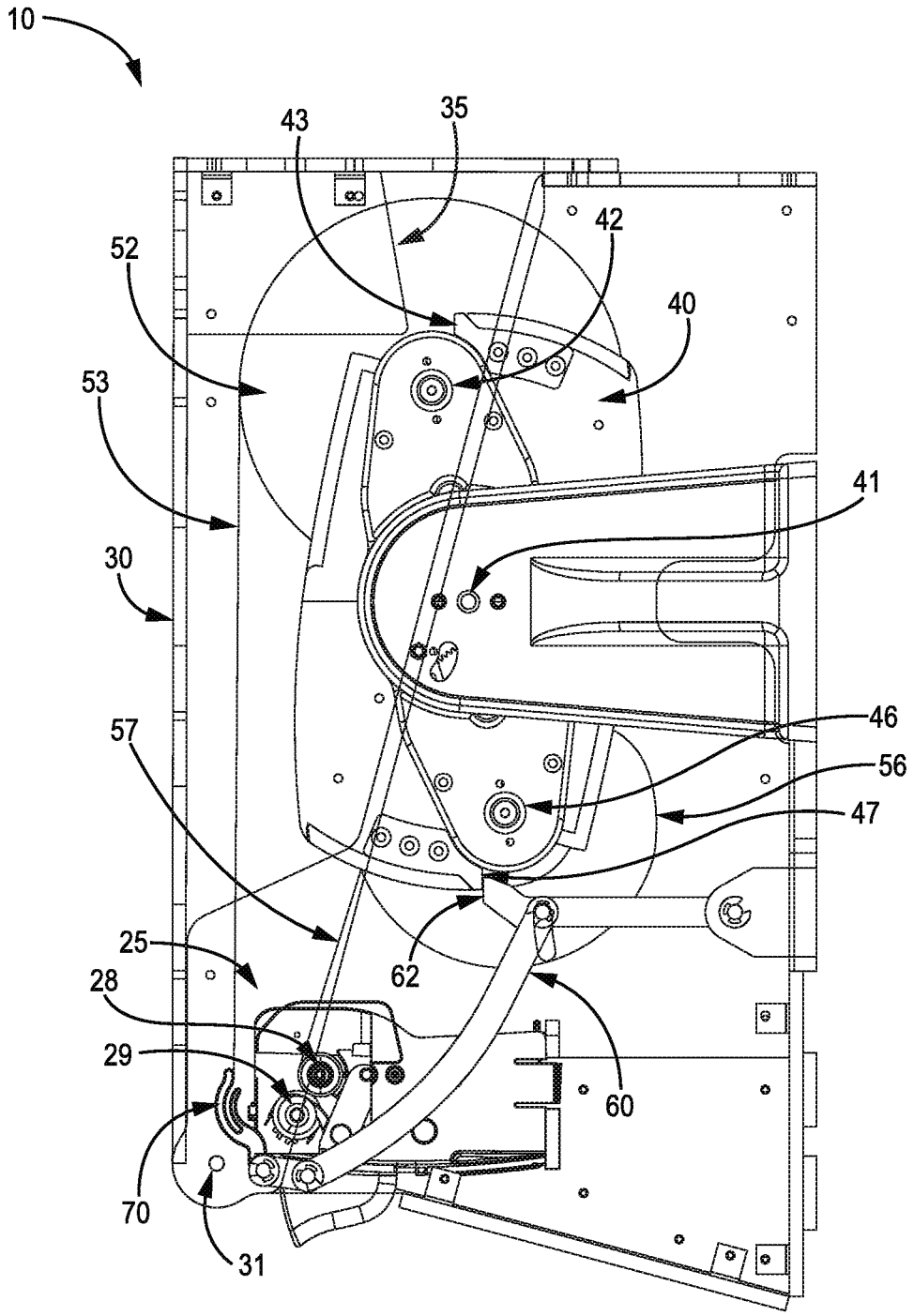
Figure 4:
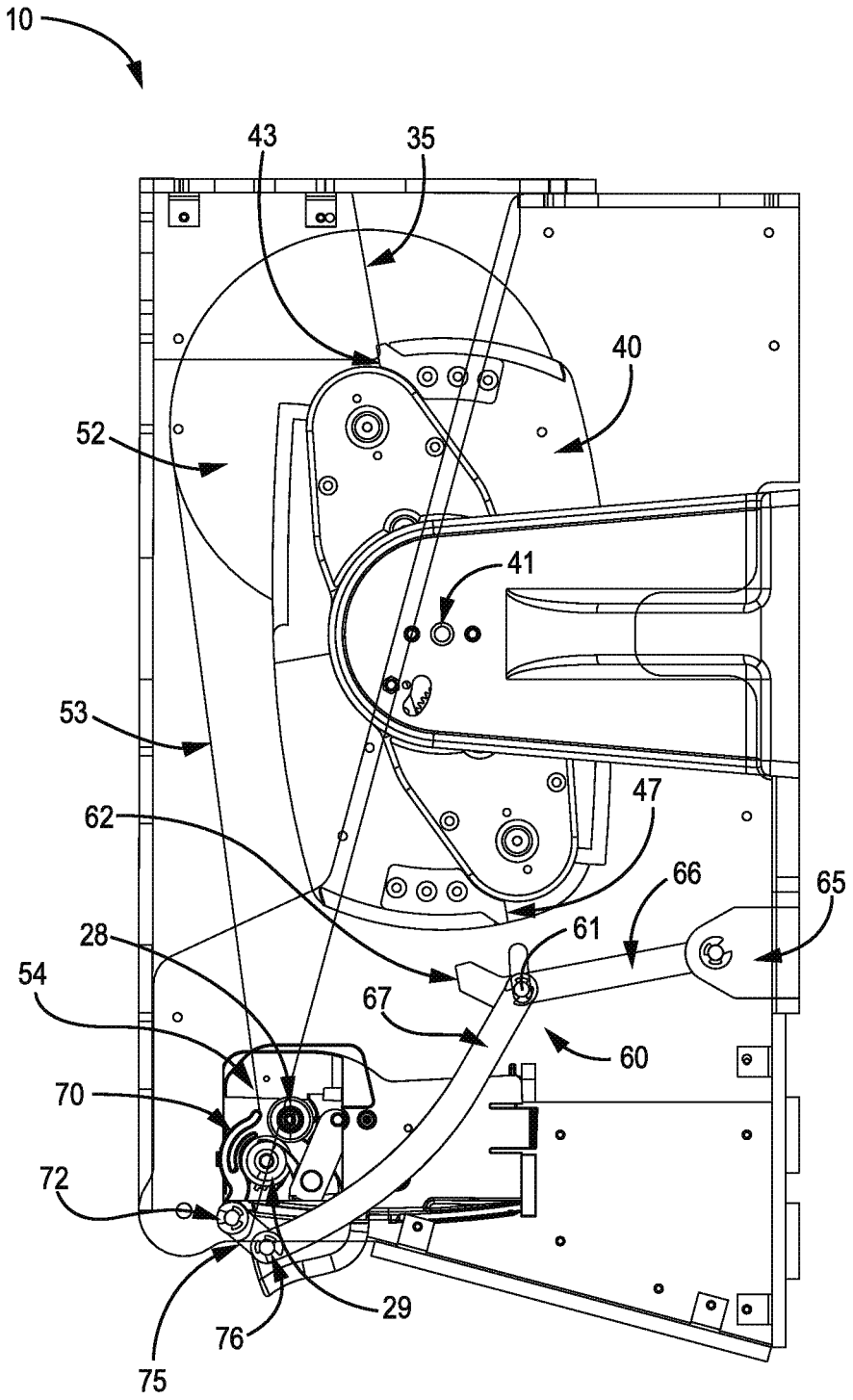
Figure 5:
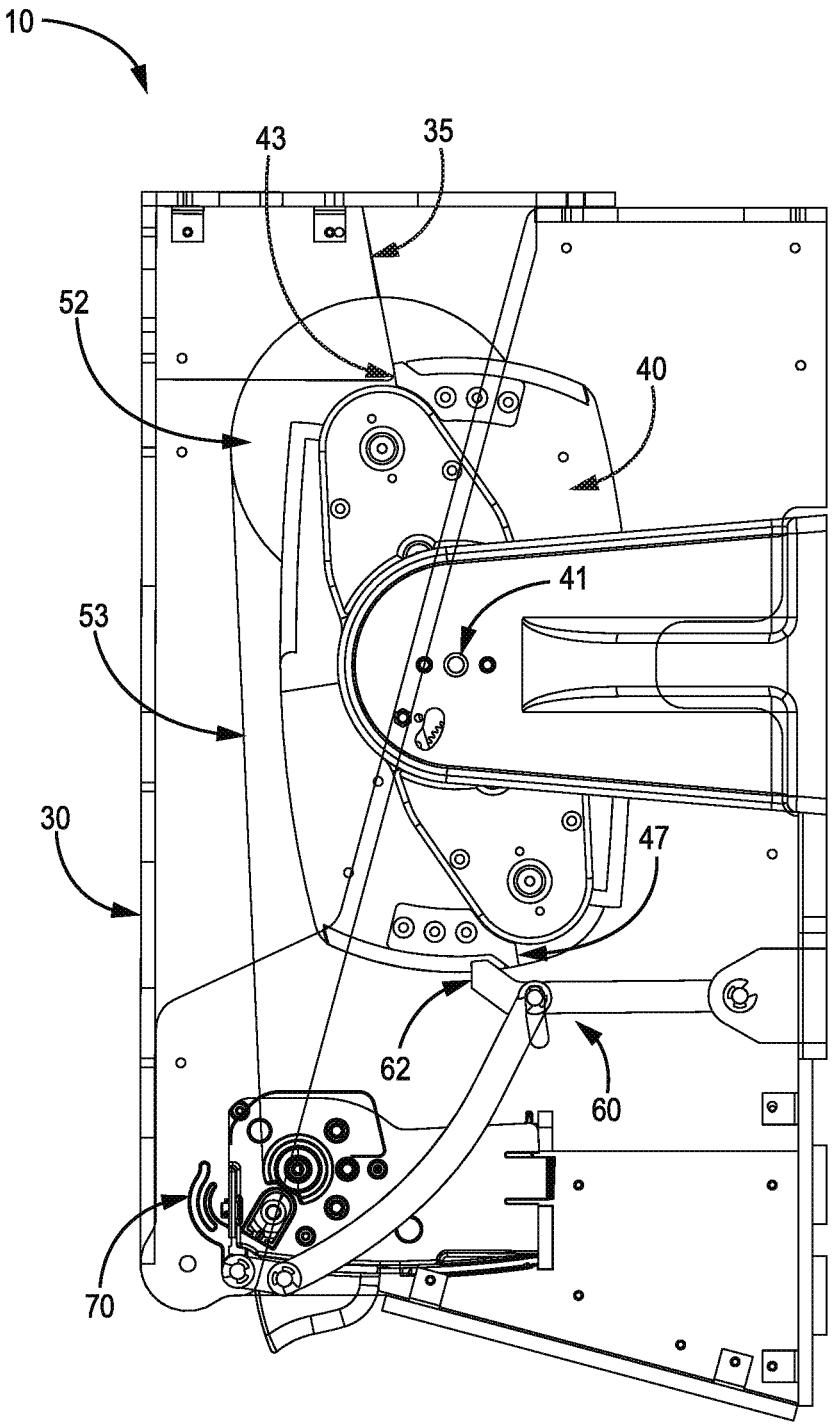
Figure 6:
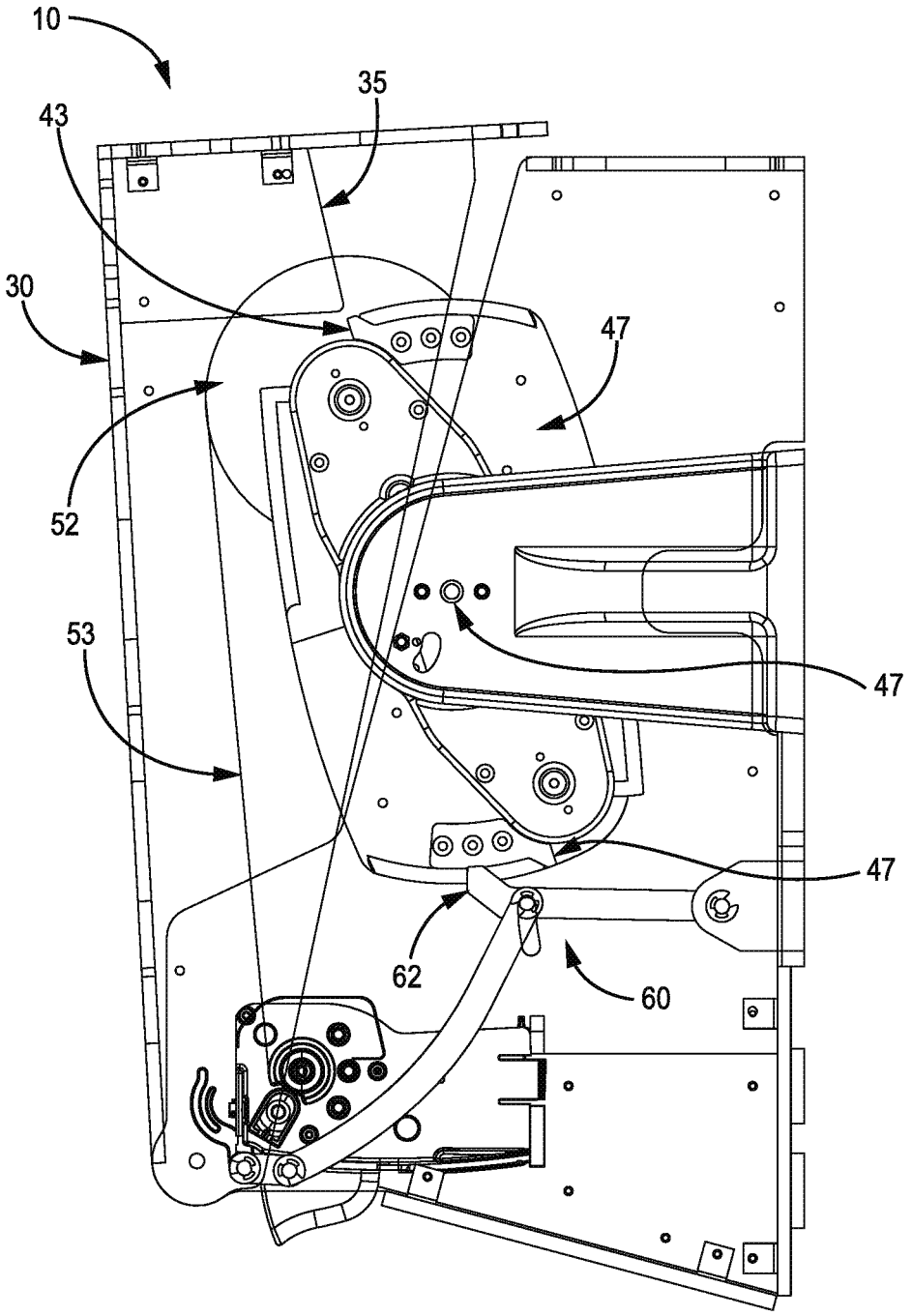
Figure 7:
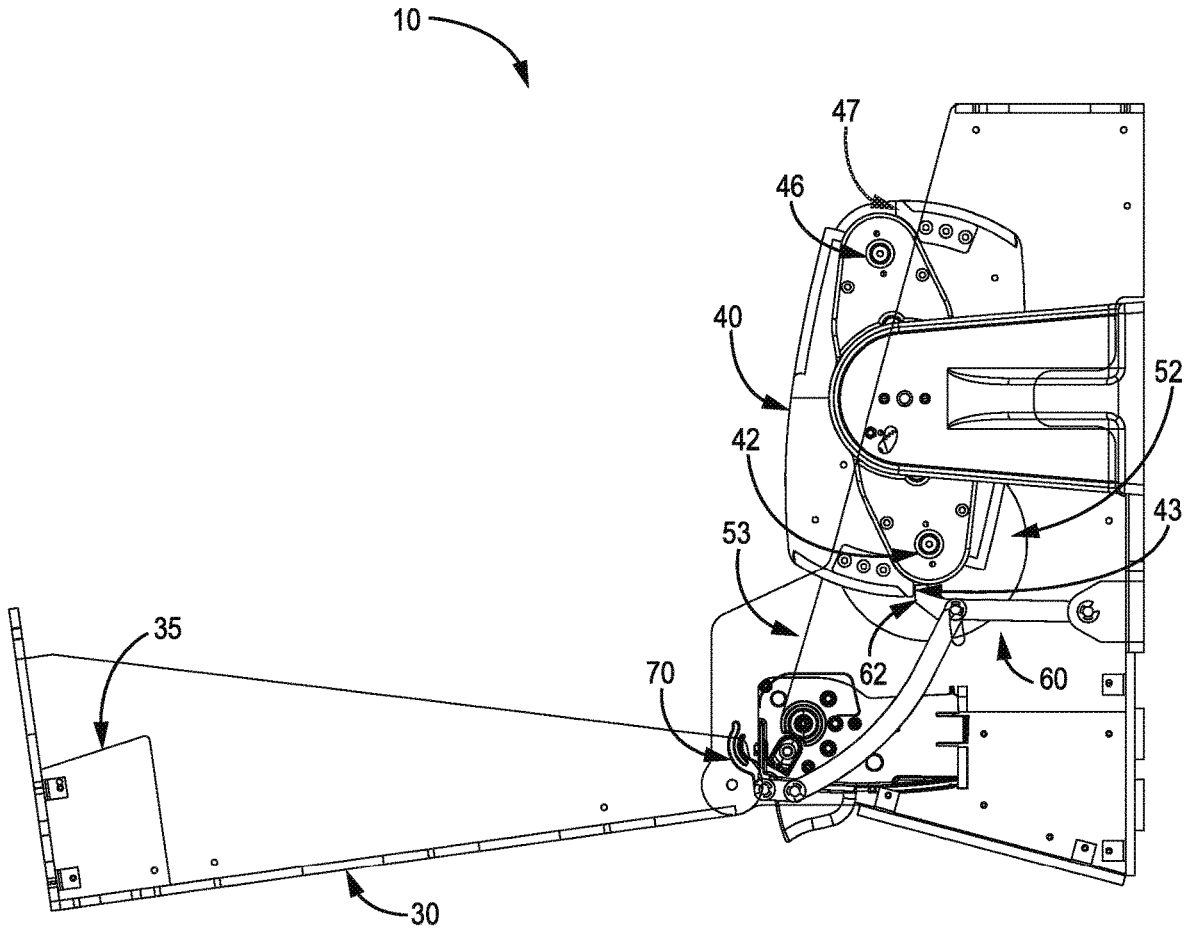
Figure 8:
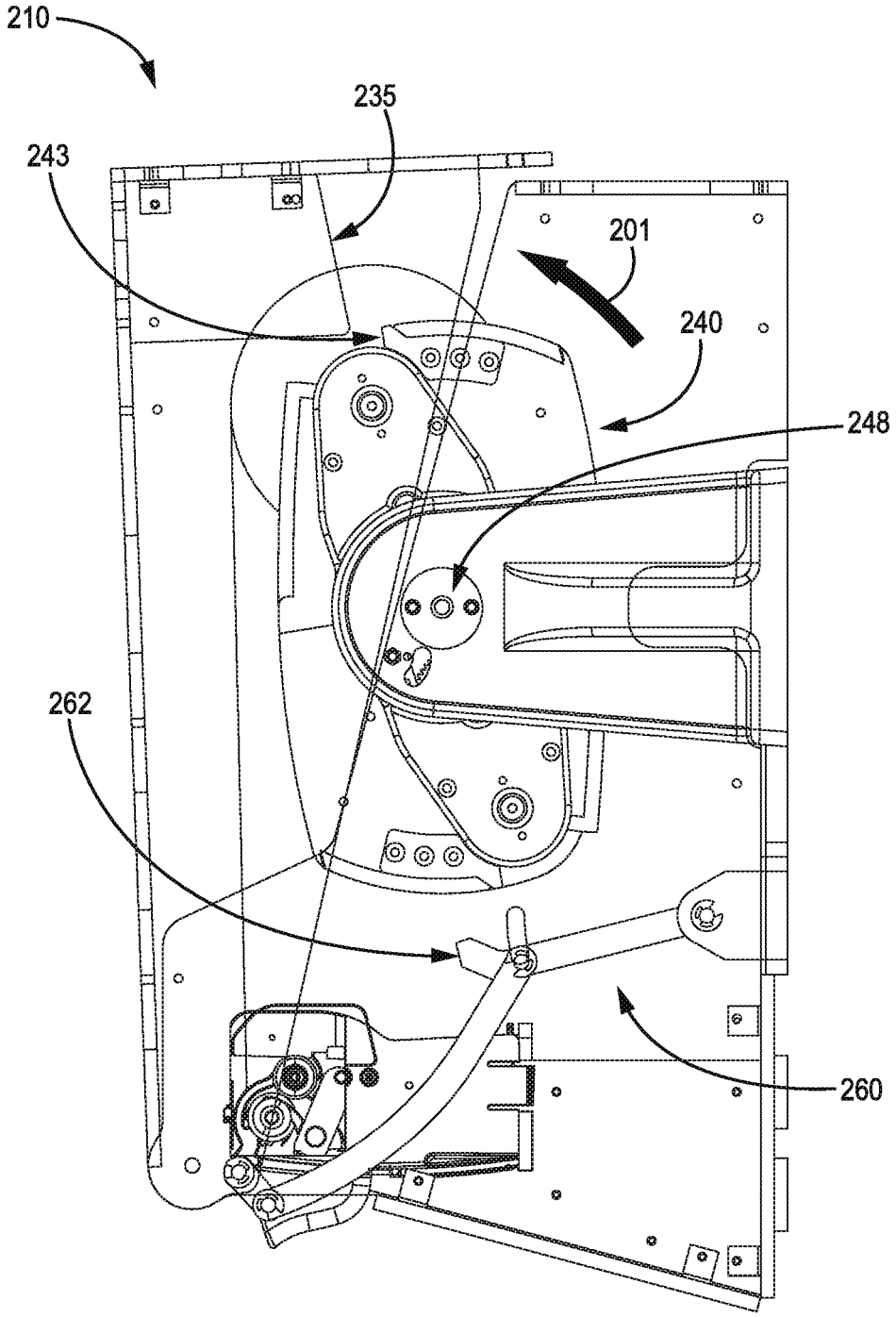
Figure 9A:
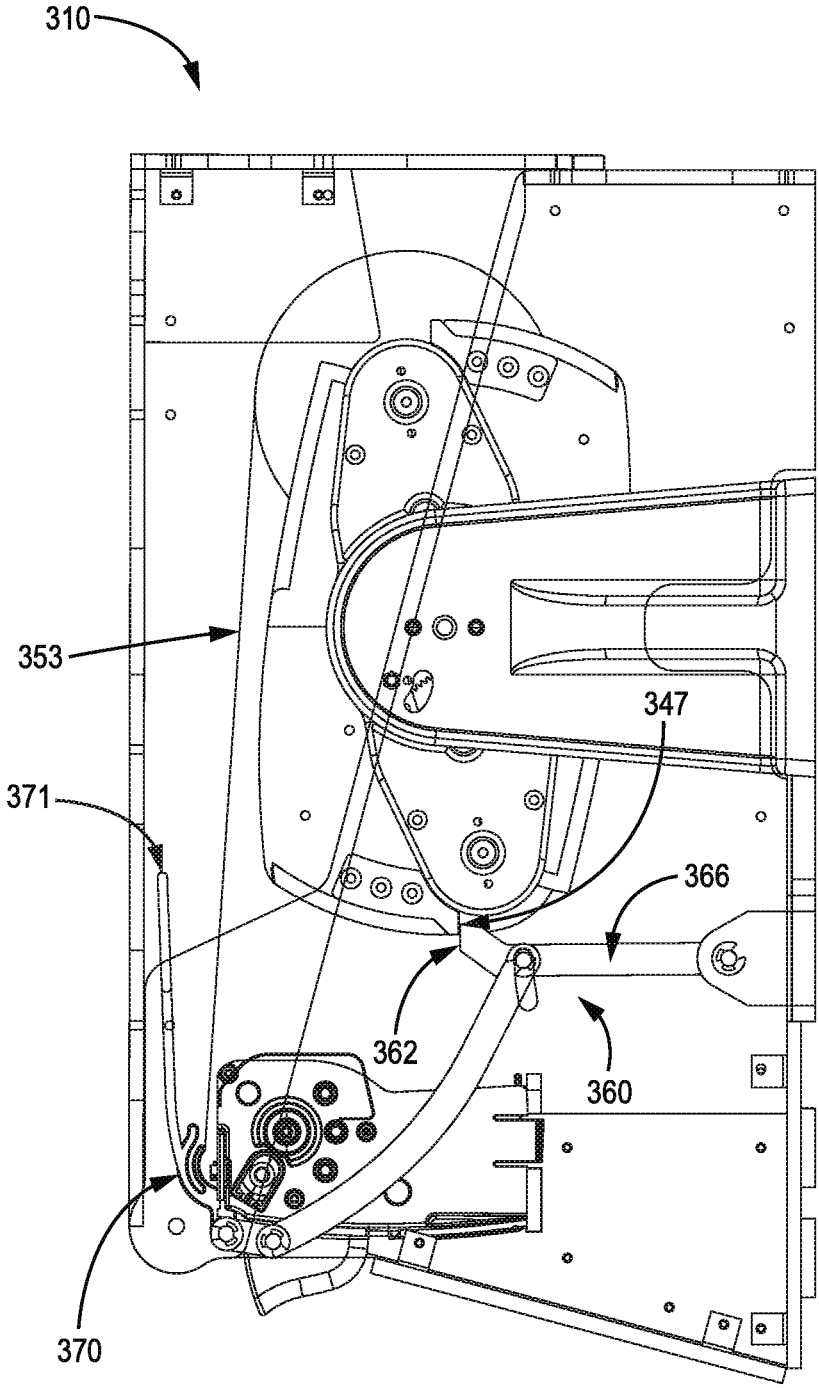
Figure 9B:
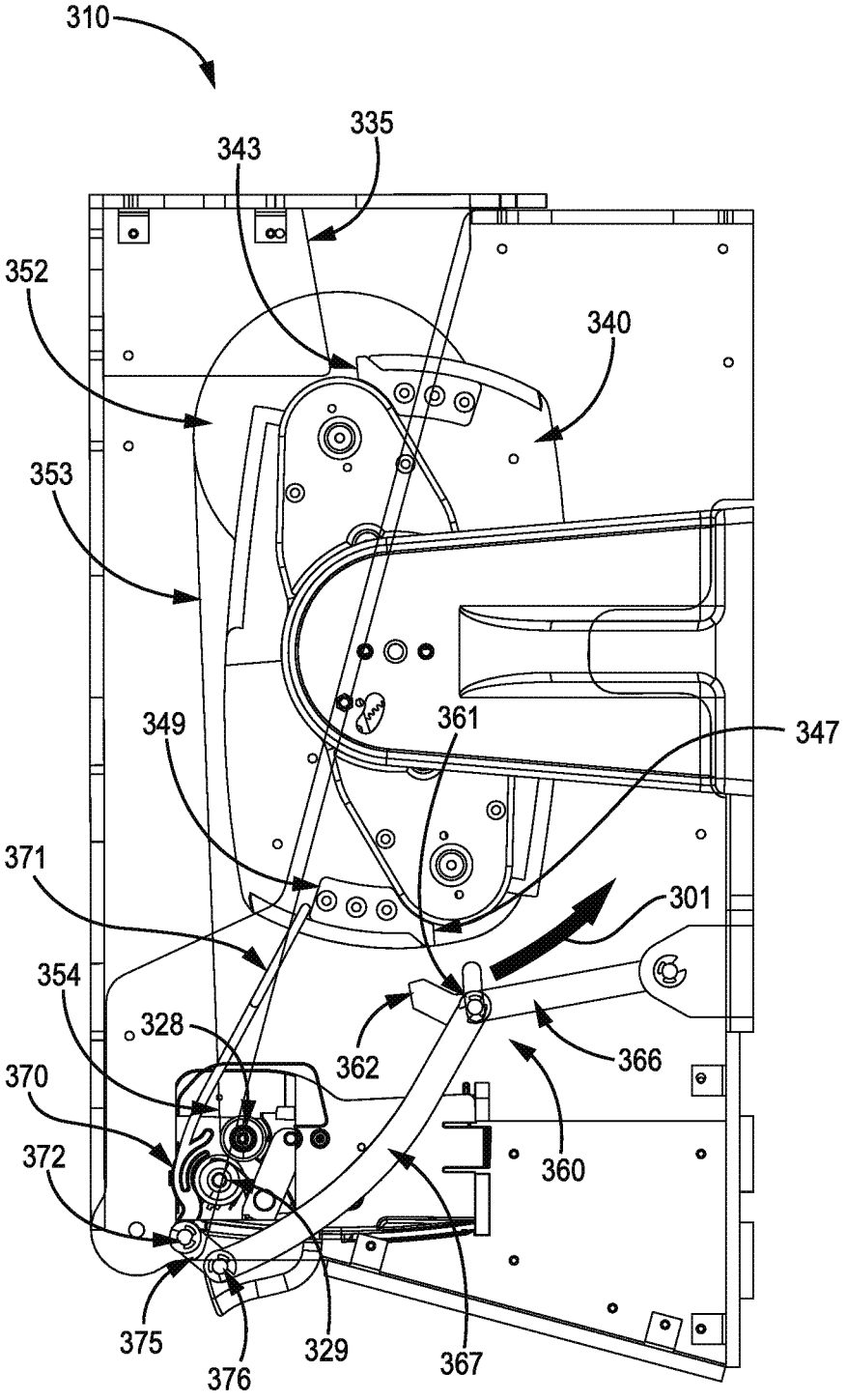
Figure 10A:
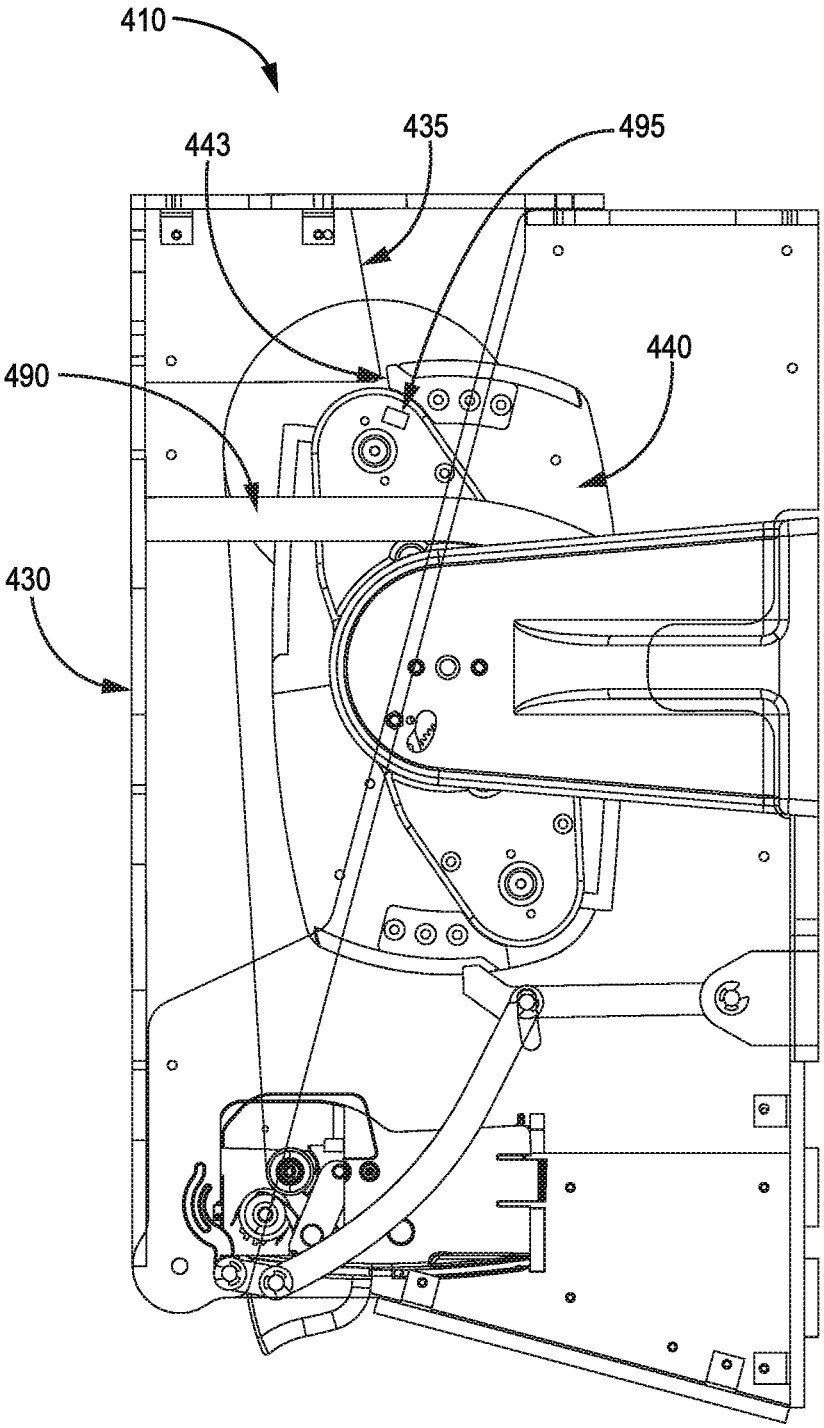
Figure 10B:
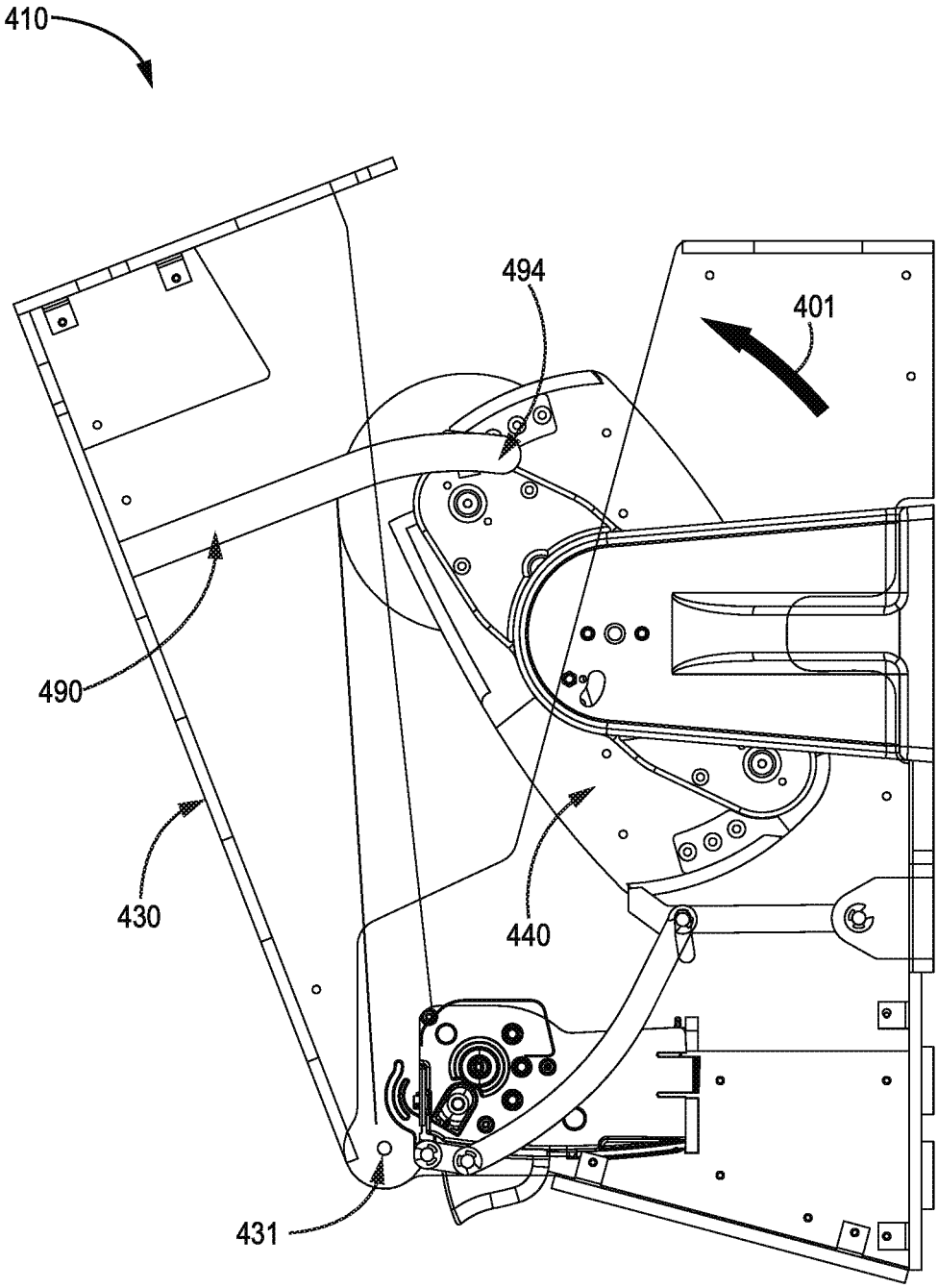
Figure 11:
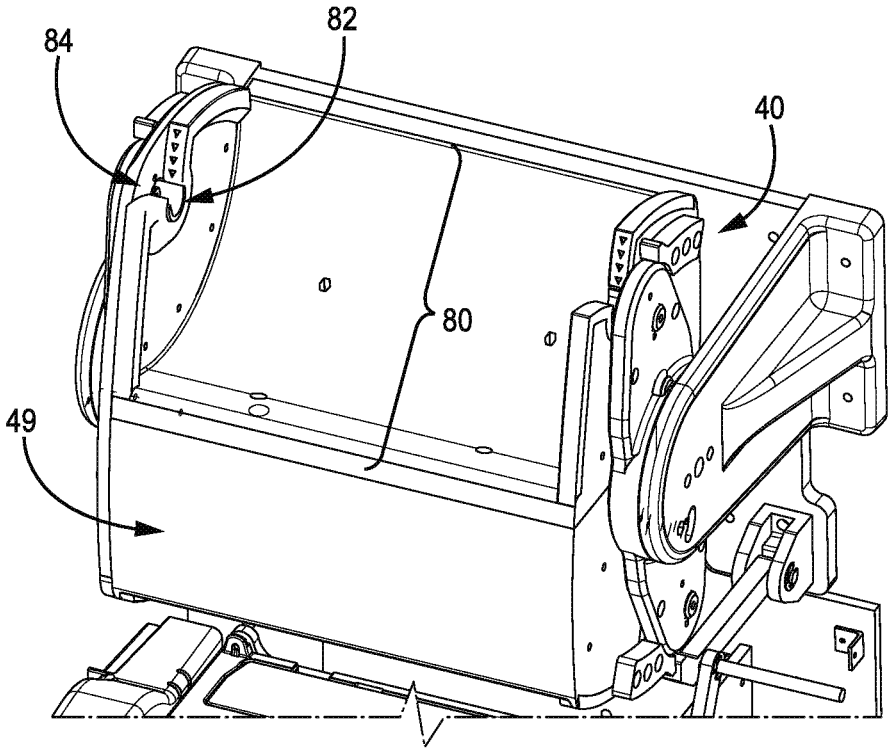
Figure 12:
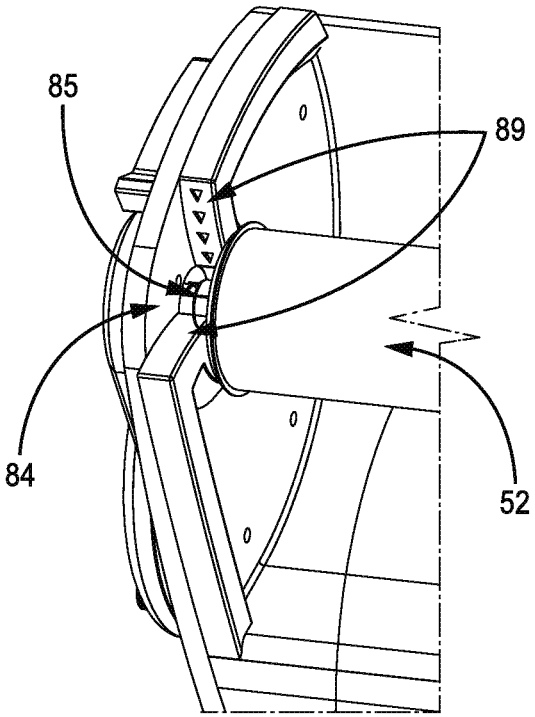
Figure 13:
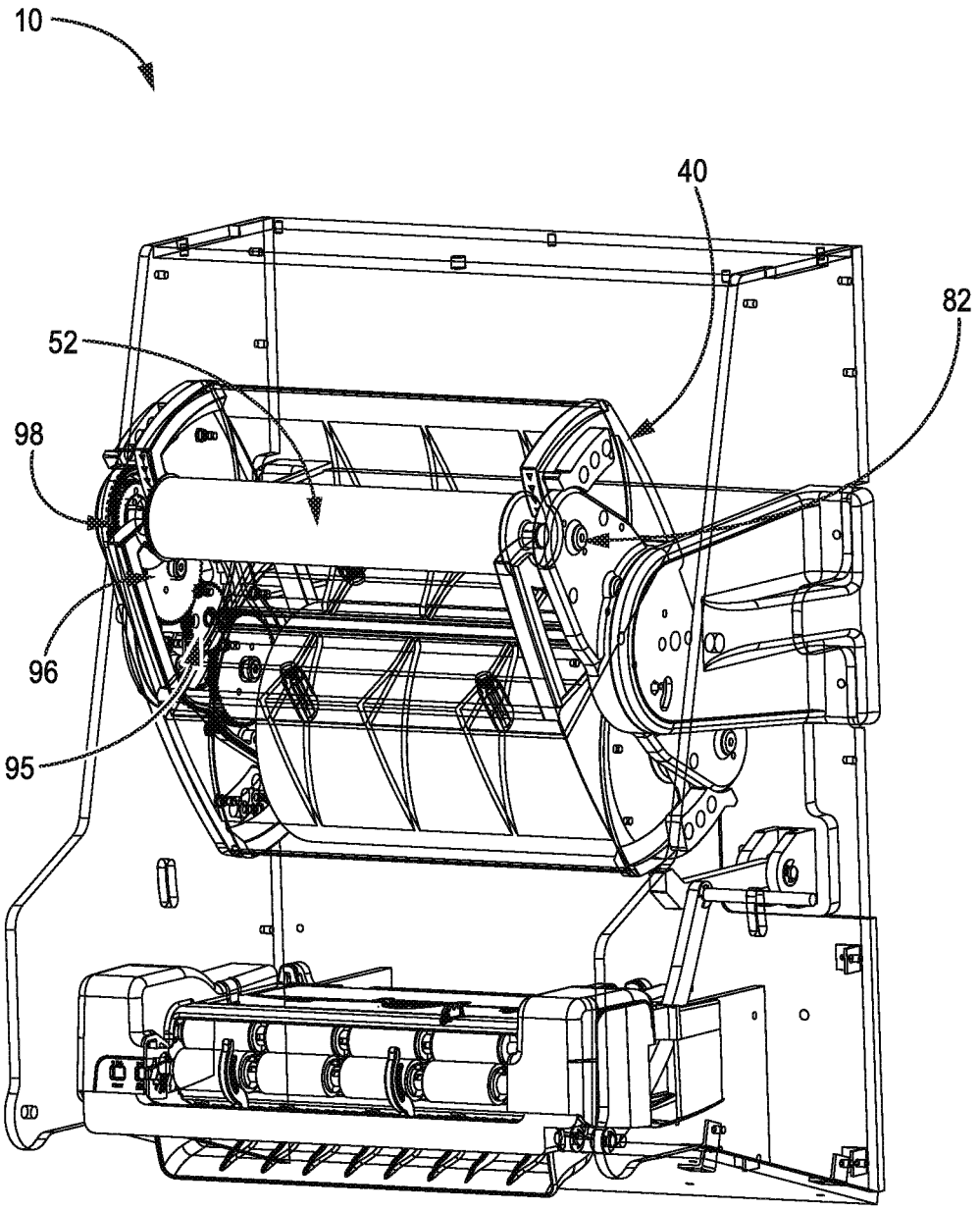
Figure 14:
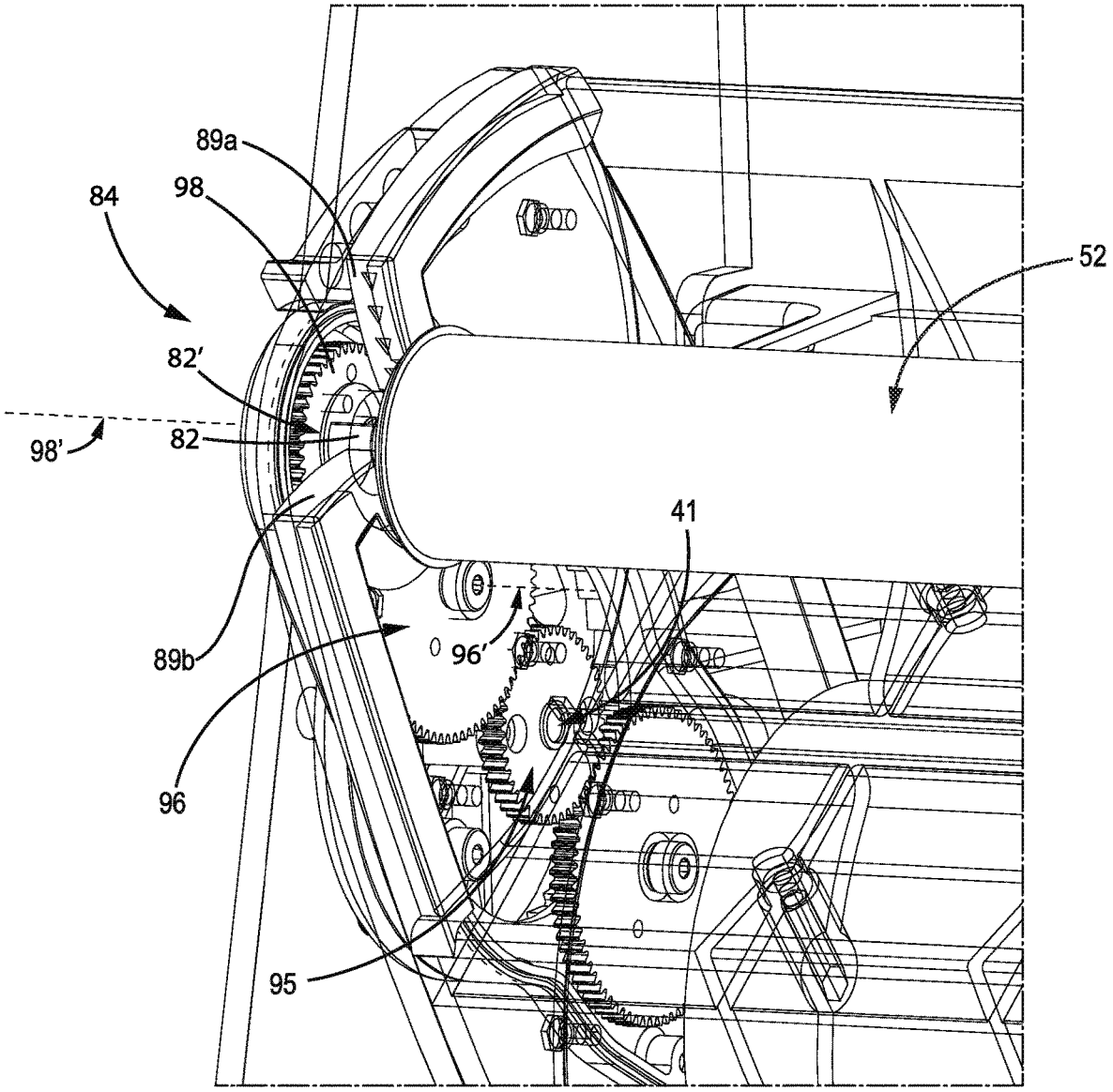
Figure 15:
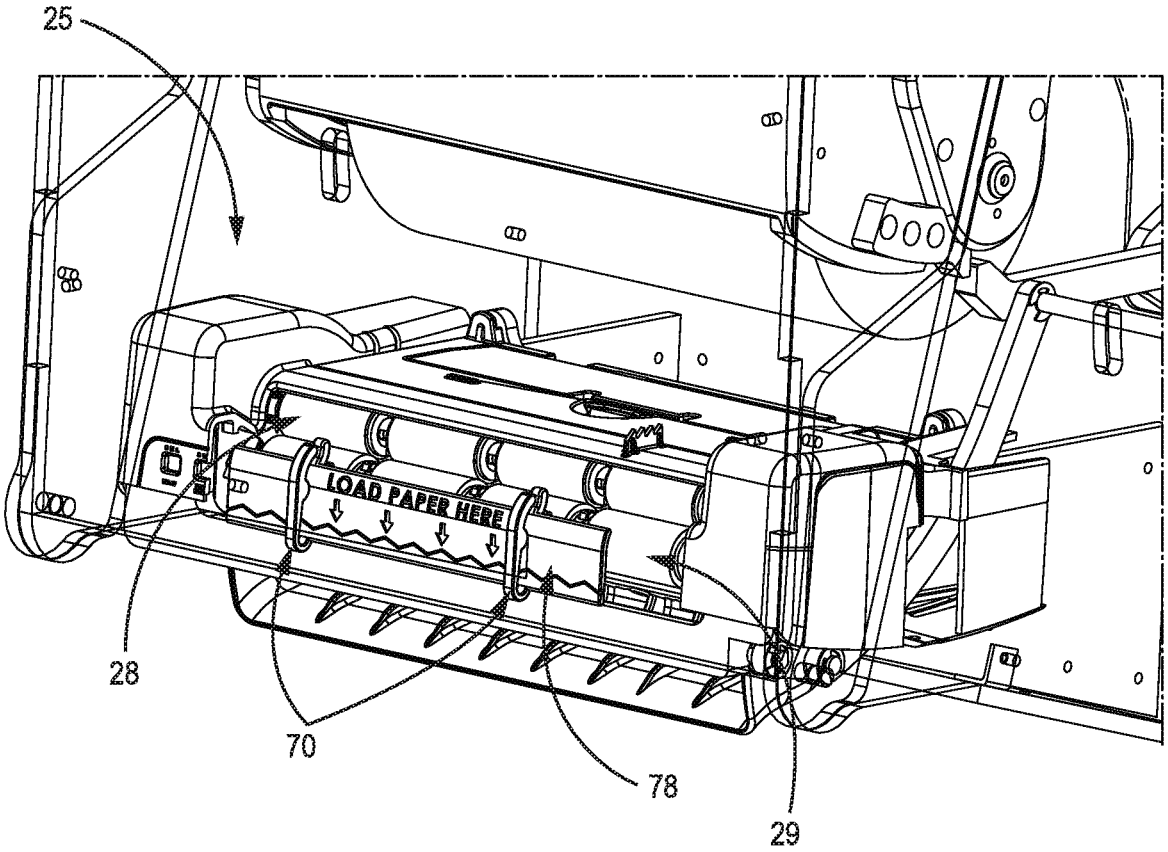
Figure 16:
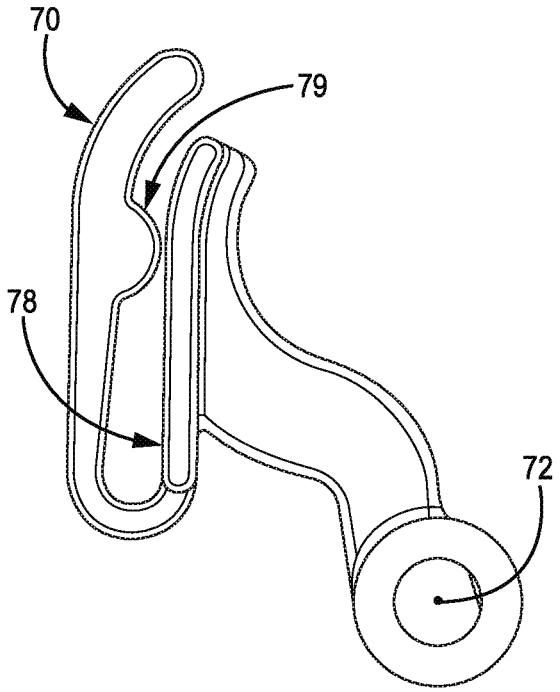
Figure 17:
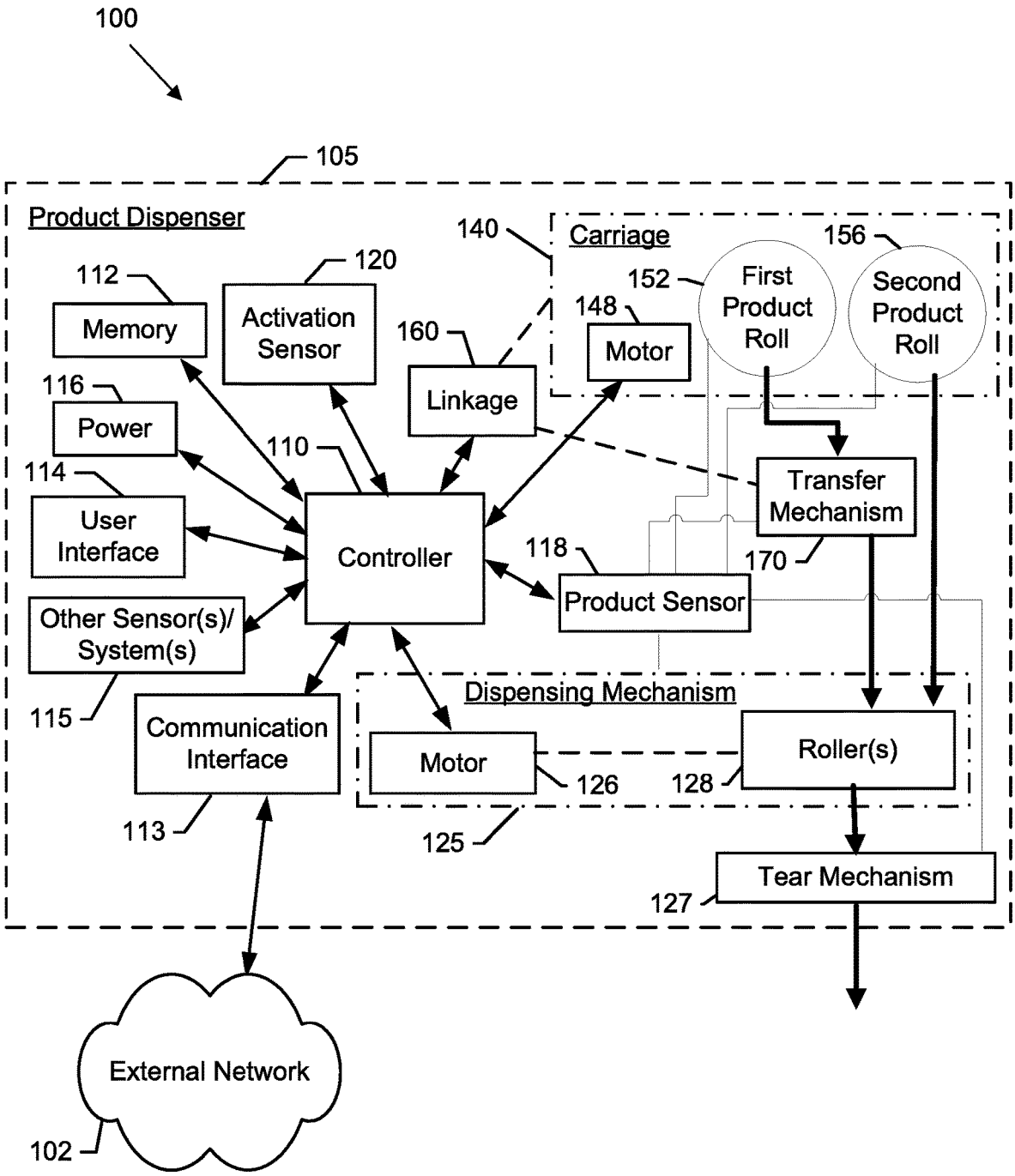
Figure 18:
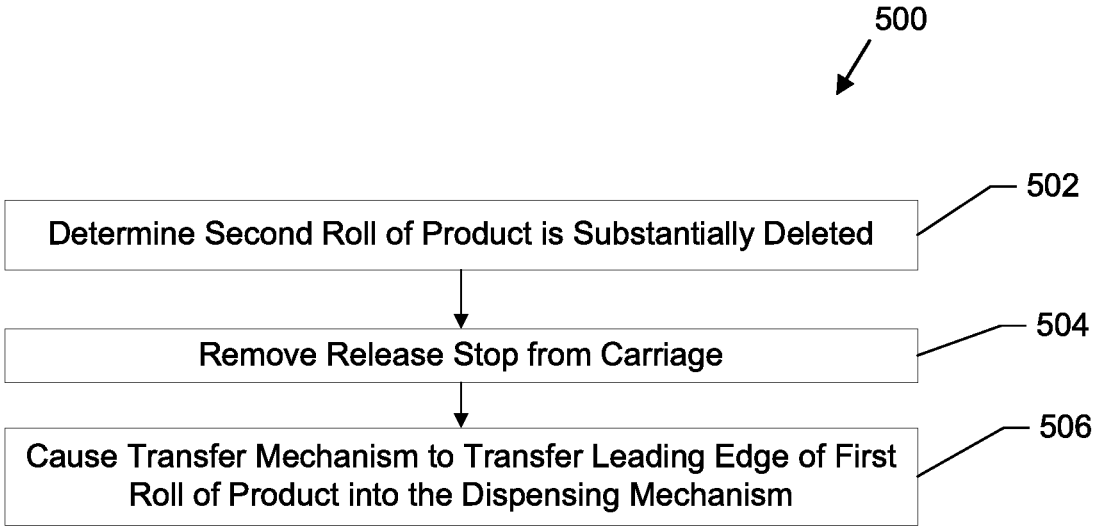
Figure 19:
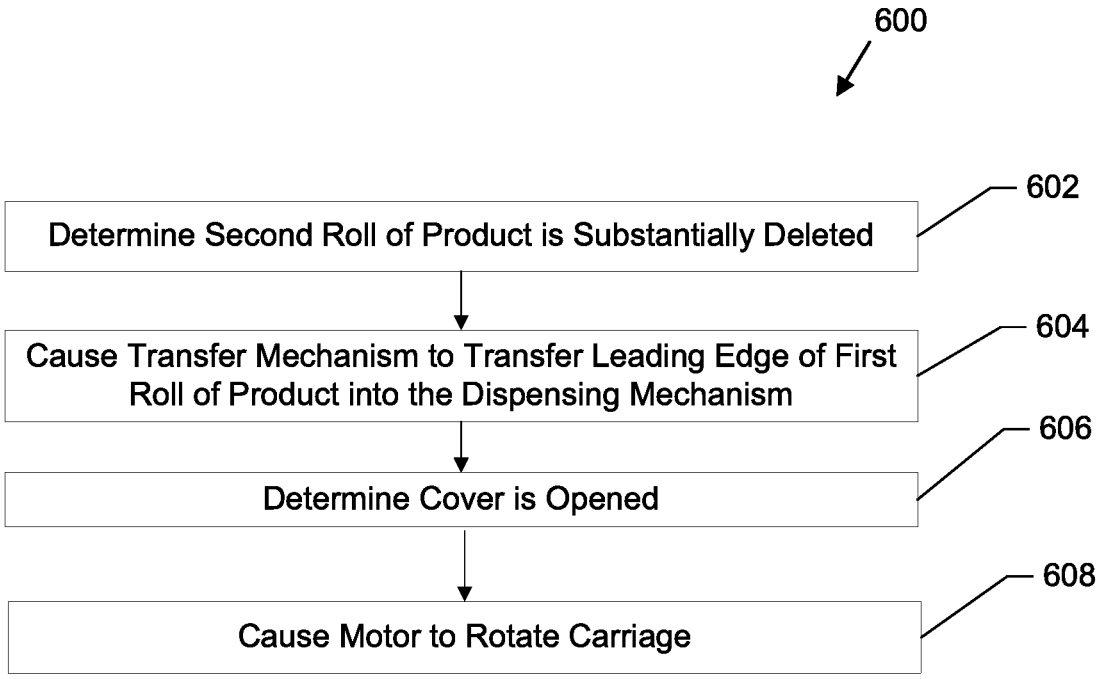

Having thus described the invention in general terms, reference will now be made to the accompanying drawings, which are not necessarily drawn to scale, and wherein:

FIG. 1 is a perspective view of an example sheet product dispenser, in accordance with some embodiments discussed herein;

FIG. 2 is a perspective view of a sheet product dispenser with a loaded first roll of product and second roll of product, wherein the cover and base portion are transparent, in accordance with some embodiments discussed herein;

FIG. 3 is a side view of the sheet product dispenser of FIG. 2, in accordance with some embodiments discussed herein;

FIG. 4 is a side view of the sheet product dispenser of FIG. 2, wherein the second roll of product has been depleted and a linkage has been moved to cause transfer of the leading edge of the first roll of product into the dispensing mechanism and removal of a release stop from interaction with a carriage, wherein the carriage has rotated to an intermediate orientation such that a carriage stop interacts with a cover stop, in accordance with some embodiments discussed herein;

FIG. 5 is a side view of the sheet product dispenser of FIG. 4, wherein the first roll of product has been dispensed from, in accordance with some embodiments discussed herein;

FIG. 6 is a side view of the sheet product dispenser of FIG. 5, wherein the cover has been opened and the carriage has begun to rotate, in accordance with some embodiments discussed herein;

FIG. 7 is a side view of the sheet product dispenser of FIG. 6, wherein the cover has been fully opened and the carriage has rotated to a second orientation where the second roll holder is accessible by a user, in accordance with some embodiments discussed herein;

FIG. 8 is a side view of another example sheet product dispenser, wherein rotation of the carriage is controlled by a motor, in accordance with some embodiments discussed herein;

FIGS. 9A-9B illustrate another example sheet product dispenser, wherein the tucker of the transfer mechanism includes an extension portion that causes rotation of the carriage, in accordance with some embodiments discussed herein;

FIGS. 10A-10B illustrate yet another example sheet product dispenser, wherein the cover includes a tang that pulls on and causes rotation of the carriage as the cover opens, in accordance with some embodiments discussed herein;

FIG. 11 is a close-up view of a portion of a carriage of an example sheet product dispenser, in accordance with some embodiments discussed herein;

FIG. 12 is a close-up view of a roll holder slot of a carriage of an example sheet product dispenser, in accordance with some embodiments discussed herein;

FIG. 13 shows a perspective view of a portion of an example sheet product dispenser with the cover open and a depleted roll of product inserted into the roll holder slot, in accordance with some embodiments discussed herein;

FIG. 14 shows a close-up, partially transparent view of the roll holder slot of an example sheet product dispenser, in accordance with some embodiments discussed herein;

FIG. 15 shows a close-up view of a transfer mechanism of an example sheet product dispenser, in accordance with some embodiments discussed herein;

FIG. 16 shows a side view of an example transfer mechanism, in accordance with some embodiments discussed herein;

FIG. 17 shows a block diagram illustrating an example system for controlling and operating an example sheet product dispenser, in accordance with some embodiments discussed herein;

FIG. 18 illustrates a flowchart of an example method of controlling and operating an example sheet product dispenser, in accordance with some embodiments discussed herein; and FIG. 19 illustrates a flowchart of another example method of controlling and operating an example sheet product dispenser, in accordance with some embodiments discussed herein.

DETAILED DESCRIPTION

Embodiments of the present invention now will be described more fully hereinafter with reference to the accompanying drawings, in which some, but not all embodiments of the invention are shown. Indeed, these embodiments may take many different forms and should not be construed as limited to the embodiments set forth herein; rather, these embodiments are provided so that this disclosure will satisfy applicable legal requirements. Like numbers refer to like elements throughout.

FIG. 1 illustrates an example sheet product dispenser 10 according to some embodiments of the present invention, such as in accordance with the sheet product dispenser 105 and its corresponding components described with respect to FIG. 17. The sheet product dispenser 10 includes a housing defined by a base portion 20 and a cover 30. The sheet product dispenser 10 includes a dispensing slot 21 where the sheet product (e.g., paper towel) is provided to the user. Such sheet product may, such as described herein, be dispensed in response to user input being provided to an activation sensor 35 (e.g., in the circumstance where the sheet product dispenser is automated).

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

With reference to FIG. 2, the sheet product dispenser 10 includes a carriage 40 that is rotatably coupled to the base portion 20 about a carriage axis 41. In some embodiments, the carriage 40 may be designed to only rotate in one direction, such as via a one-way clutch. The carriage 40 includes a first roll holder 42 positioned proximate a first end and a second roll holder 46 positioned proximate a second end. The first roll holder 42 is configured to receive and hold a roll of sheet product (e.g., the first product roll 52). The second roll holder 46 is also configured to receive and hold a roll of sheet product (e.g., the second product roll 56).

In some embodiments, the housing and the carriage of the sheet product dispenser are designed such that the roll holders may each receive a full-sized (e.g., full-diameter) product roll. In this regard, when the cover is in the closed position, the housing is sized such that both the first roll holder and the second roll holder are configured to each hold a full size sheet product roll in a substantially vertical orientation with respect to each other (e.g., including a slightly offset vertical orientation—such as shown in FIG. 2). Further, though the above described multi-roll dispenser includes two roll holders, some embodiments of the present invention are not meant to be limited to two roll holders, as any number of roll holders may be utilized with the present invention.

In some embodiments, the carriage 40 is rotatable between various orientations. For example, the carriage 40 is rotatable between a first orientation and a second orientation. In the first orientation, the first product roll 52 (when installed), first roll holder 42, and first end faces generally upwardly and the second product roll 56 (when installed), second roll holder 46, and second end faces generally downwardly (see e.g., FIG. 2). In this regard, the first roll holder 42 and first product roll 52 are positioned substantially vertically above the second roll holder 46 and the second product roll 56 in the first orientation. In the second orientation the first product roll 52 (when installed), first roll holder 42, and first end faces generally downwardly and the second product roll 56 (when installed), second roll holder 46, and second end faces generally upwardly (see e.g., FIG. 7). In this regard, the second roll holder 46 and second product roll 56 are positioned substantially vertically above the first roll holder 42 and the first product roll 52 in the second orientation.

In some embodiments, other orientations are contemplated, such as one or more intermediate orientations between the first orientation and the second orientation. In this regard, an intermediate orientation may be an orientation of the carriage 40 that may occur during rotation between the first orientation and the second orientation. As will be described in greater detail herein, FIGS. 4-5 illustrate the carriage 40 in an example intermediate orientation.

As shown in FIGS. 2-3, the sheet product dispenser 10 is configured such that the second product roll 56 is the primary product roll that is currently being dispensed from. In this regard, a leading edge 57 of the second product roll 56 is loaded into the dispensing mechanism 25 and configured for dispensing therefrom. For example, the leading edge 57 of the second product roll 56 is fed between a pinch roller 29 and a drive roller 28 of the dispensing mechanism 25. In some embodiments, a motor (not shown) is configured to drive, such as in response to user input being provided to an activation sensor, the drive roller 28 to cause a portion of the second product roll 56 to be dispensed from the sheet product dispenser 10. In some embodiments, a tear mechanism (e.g., the tear mechanism 127 of FIG. 17) enables removal of the portion dispensed.

Further, with reference to FIGS. 2-3, the sheet product dispenser 10 is configured such that the first product roll 52 is the secondary roll such that the sheet product dispenser 10 may switch to dispensing from the first product roll 52 when the second product roll 56 is depleted (or substantially depleted). In this regard, the leading edge 53 of the first product roll 52 is loaded into tucker fingers 70 of a transfer mechanism (e.g., the transfer mechanism 170 of FIG. 17). In some embodiments, the tucker fingers 70 may be configured to "tuck" the leading edge 53 of the first product roll 52 between the drive roller 28 and pinch roller 29 of the dispensing mechanism 25 to begin dispensing therefrom—such as in response to determining that the second product roll 56 has been substantially depleted. Though the above described embodiment employs tucker fingers for the transfer mechanism, other transfer mechanisms are contemplated by embodiments of the present invention (such as transfer rollers). In such embodiments, there may be a continuous supply of sheet product to the user even when the second product roll 56 runs out of sheet product.

In some embodiments (such as shown in FIG. 2), the carriage 40 may define a back wall 49 that helps guide a user in properly loading the leading edge 53 of the first product roll 52 into the tucker fingers 70. Additionally or alternatively, the back wall 49 may also help separate the web paths for the first product roll 52 and the second product roll 56 to avoid tangling of the sheet products—thereby avoiding possible jamming scenarios. In some embodiments, instructions, such as for loading the product roll, may be provided on the back wall 49. In some embodiments, the back wall may block or prevent access to a current product roll that is being dispensed from (i.e., in the bottom and back of the sheet product dispenser) so as to prevent the user from replacing a product roll that is still usable.

Though FIGS. 2-3 depict the first product roll 52 as the secondary roll and the second product roll 56 as the primary roll, the designation of the first product roll 52 and the second product roll 56 may be switched. Indeed, such a switch is designed to occur automatically in some embodiments of the present invention, such as with rotation of the carriage. In this regard, when in the second orientation (shown in FIG. 7), the first product roll 52 would be the primary roll (after transfer has occurred) and the second product roll (once replaced) would be loaded with its leading edge in the tucker finger such that it is designated as the secondary roll.

In some embodiments, the cover 30 is rotatably connected to the base portion 20 about a cover hinge that rotates about a cover hinge axis 31 between a closed position (shown in FIG. 2) and an opened position (shown in FIG. 7). As detailed herein, in some embodiments, the cover 30 may define a cover stop 35 that can interact with a portion of the carriage 40 (such as to help the carriage 40 define an intermediate orientation). Additionally or alternatively, in some embodiments, the sheet product dispenser 10 may include one or more cover sensors (not shown) that sense when the cover has been opened (such as may be used in embodiments where a motor is used to cause rotation of the carriage).

In some embodiments, the sheet product dispenser 10 includes a linkage 60 that is mechanically controlled by a controller (e.g., controller 110 shown in FIG. 17). The linkage 60 may define a number of different arms (e.g., first arm 66 and second arm 67 shown in FIG. 4).

The linkage 60 may also define or interact with a tucker lever 75 that is connected to the tucker fingers 70. In some embodiments, the linkage 60 may be configured to cause the tucker fingers 70 to rotate or move to cause transfer of the leading edge of the corresponding product roll into the dispensing mechanism 25.

The linkage 60 may further define a release stop 62 that is configured to interact with a portion of the carriage 40 to disable or prevent rotation of the carriage 40. The release stop 62 may be movable (via the linkage) between an engaged position (shown in FIG. 3) and a disengaged position (shown in FIG. 4). In the engaged position, the release stop 62 may interact with a portion of the carriage 40 to prevent rotation of the carriage 40. When in the disengaged position, the release stop 62 may be out of interaction with the portion of the carriage 40 such that it is free to rotate.

As such, depending on the configuration, the linkage 60 may be configured to mechanically interact with one or more different components of the sheet product dispenser 10 to enable mechanical influence or control over the one or more components.

In some embodiments, the carriage 40 may be biased so as to promote rotation. For example, the carriage 40 may be biased due to gravity (e.g., acting upon the first product roll 52) to promote rotation accordingly. Additionally or alternatively, the carriage 40 may be biased with a spring or other biasing element to promote rotation in one or more directions. In the depicted embodiment, when in the first orientation shown in FIG. 4, the carriage 40 is biased to rotate in the counterclockwise direction. In order to prevent such rotation, the carriage 40 may define a second carriage stop 47 proximate the second end that interacts with the release stop 62 when the carriage 40 is in the first orientation and the release stop 62 is in the engaged position (shown in FIG. 3). In some embodiments, a similar carriage stop (the first carriage stop 43) may be positioned proximate the first end of the carriage 40. Notably, when the carriage 40 rotates to the second orientation and the release stop 62 is in the engaged position, the first carriage stop 43 may engage with the release stop 62 to prevent counterclockwise rotation (shown in FIG. 7).

In some embodiments, the sheet product dispenser 10 includes one or more product sensors (e.g., product sensor 118 shown in FIG. 17). In some embodiments, the product sensor may be configured to sense product data corresponding to dispensing from at least one of the first product roll or the second product roll (e.g., how much product is being dispensed, when product is being dispensed, which product roll is dispensing occurring from, etc.). Additionally or alternatively, the product sensor may be configured to sense product data corresponding to an amount of product remaining for at least one of the first product roll or the second product roll (e.g., a remaining size of the product roll, an amount of the product roll remaining, etc.). The product sensor may be positioned anywhere in the sheet product dispenser 10 and may interact with any component of the sheet product dispenser 10 to sense product data. For example, depending on the configuration of the product dispenser 105 and/or the desired information/product data, one or more product sensors 118 may be configured to sense data from the first product roll 152, the second product roll 156, the transfer mechanism 170, the dispensing mechanism 125, the tear mechanism 127, and/or other components of the product dispenser 105 (e.g., a dispensing slot, etc.).

In some embodiments, the controller (e.g., controller 110 shown in FIG. 17) may be configured to receive the product data and perform one or more determinations regarding the product data. For example, the controller may be configured to determine, based on the product data from the product sensor, an instance in which a product roll is at least substantially depleted. Such a determination, in some embodiments, may be made by counting the number of dispenses or the amount of sheet product dispensed and subtracting it from a known or assumed amount of sheet product on the product roll. In other embodiments, the diameter or size remaining of the product roll may be measured such that the amount of sheet product remaining can be determined. In some embodiments, other types of determinations can be made by the controller, such as which product roll is dispensing, if there is leftover product in an exit chute, if a successful transfer occurred, the orientation of the carriage, if there is a product jam, among others.

In some embodiments, in response to determining that a product roll is at least substantially depleted, the controller may be configured to enable rotation of the carriage. For example, in some embodiments, the controller may be configured to cause rotation of the carriage 40, such as by controlling a carriage motor (such as described in greater detail with respect to FIG. 8). Additionally or alternatively, the controller may be configured to cause rotation of the carriage to occur due to a bias (e.g., gravity, spring bias, etc.). In such embodiments, the controller may be configured to move a release stop that is otherwise preventing rotation of the carriage 40.

With reference to FIG. 4, in some embodiments, the carriage 40 is designed to undergo a staged rotation such that the carriage 40 rotates to an intermediate orientation between the first orientation and the second orientation. For example, the controller may be configured to determine an instance in which the second product roll 56 is at least substantially depleted. Then, in response, the controller may operate/move the linkage 60 to move the release stop 62 from the engaged position (where it interacts with the second carriage stop 47, such as shown in FIG. 3) to a disengaged position (disposed from interaction with the second carriage stop 47, such as shown in FIG. 4).

In some embodiments, movement of the linkage 60 may be accomplished with a motor (not shown), however other mechanical or electrical means are contemplated (e.g., solenoid, actuator, etc.). In the depicted embodiment, the first arm 66 of the linkage 60 is rotated downwardly about a first linkage axis 65. This causes the release stop 62 to disengage from interaction with the second carriage stop 47. With the release stop 62 disengaged, the carriage 40 is free to rotate (such as by its bias) from the first orientation (e.g., counterclockwise in FIG. 4). As the carriage 40 rotates counterclockwise, the first carriage stop 43 (proximate the first end) is stopped by the cover stop 35. This interaction between the cover stop 35 and the first carriage stop 43 prevents further rotation of the carriage 40 such that the carriage 40 now is in the intermediate orientation.

In some embodiments, the linkage 60 is designed such that movement of the linkage simultaneously moves the release stop 62 (such as described above) and causes the transfer mechanism to transfer the leading edge of the secondary roll (e.g., the leading edge 53 of the first product roll 52) into the dispensing mechanism 25 to cause transfer of dispensing from the depleted second product roll 56 to the first product roll 52. For example, with reference to FIG. 4, as the first arm 66 of the linkage 60 rotates about the first linkage axis 65, the second arm 67 of the linkage 60 also moves, rotating around a second linkage axis 61. Movement of the second arm 67 then in turn causes movement of a tucker lever 75 and the tucker fingers 70 about the tucker finger axis 72 to move the tip 54 of the leading edge 53 of the first product roll 52 between the drive roller 28 and the pinch roller 29 of the dispensing mechanism 25. Thereafter, operation of the dispensing mechanism 25 may be configured to pull the tip 54 of the leading edge 53 of the first product roll 52 further into the dispensing mechanism for subsequent dispensing.

With the transfer complete, the linkage 60 returns to its original position and the sheet product dispenser 10 is now ready to continue providing dispenses of sheet product from the first product roll 52. For example, FIG. 5 shows a partially depleted first product roll 52 and the linkage 60 in its original position. Notably, the release stop 62 is in position to engage and stop the first carriage stop 43 when the carriage 40 has been rotated to the second orientation (such as described herein).

In some embodiments, with rotation enabled by the controller (such as in response to a determination that the second product roll is at least substantially depleted), the carriage may be configured to automatically rotate in response to the cover being opened. In this regard, the carriage may rotate to present a recently depleted product roll for easy replacement by a user.

FIGS. 6-7 illustrate an example configuration where opening of the cover 30 causes the carriage 40 to automatically rotate from the intermediate orientation to the second orientation. In this regard, as described above with respect to FIG. 5, the carriage 40 has already rotated from the first orientation to the intermediate orientation, and is being held there by interaction between the first carriage stop 43 and the cover stop 35. With reference to FIG. 6, as a user opens the cover, the cover stop 35 is removed from engagement with the first carriage stop 43. In such a configuration, the carriage 40 may be biased to rotate counterclockwise such that removal of such engagement causes the carriage 40 to rotate to the second orientation with the first product roll 52 positioned near the bottom of the sheet product dispenser 10 and the second roll holder 46 and depleted second product roll 56 (not shown) near the top of the sheet product dispenser 10 (and accessible by the user). The automatic rotation of the carriage 40 causes the depleted product roll to be presented to the user for easy removal and replacement.

The user may then install the replacement product roll in the second roll holders 46 and load the leading edge into the tucker fingers 70. Finally, the user may close the cover 30 such that sheet product dispenser 10 contains two product rolls. Notably, the carriage 40 is in the second orientation and the prior first product roll 52 is now the primary roll with the replacement roll (not shown) designated as the secondary roll. In this regard, some embodiments of the present invention provide mirrored parts with respect to the first end and the second end of the carriage 40 (e.g., the first carriage stop 43 and the second carriage stop 47) such that the carriage 40 is able to continuously rotate in segments as the user continues to replace depleted product rolls in the sheet product dispenser 10.

Though FIGS. 2-7 show an example embodiment where the carriage is configured to undergo staged rotation via a bias, some embodiments contemplate undergoing only one rotation (e.g., directly from the first orientation to the second orientation without stopping in any intermediate orientation). Likewise, multiple intermediate orientations stops may occur. Such configurations could be accomplished by one or more stops positioned on various components of the sheet product dispenser.

Along similar lines, in some embodiments, rotation of the carriage may be controlled, such as by a carriage motor. FIG. 8 shows an example sheet product dispenser 210 with a carriage 240 that has received a first product roll. In the depicted embodiment, the controller has moved the linkage 260 to disengage the release stop 262 and initiate transfer to the first product roll (such as in response to determining that the second product roll was substantially depleted). The sheet product dispenser 210 also includes a cover stop 235 and a first carriage stop 243.

In some embodiments, the sheet product dispenser 210 may include a cover opening sensor that is configured to sense when the cover is opened. Upon a determination that the cover is being opened, the controller may be configured to cause the motor 248 to rotate the carriage 240 according to the arrow 201 such that the carriage changes orientation to present the user with the depleted second product roll for replacement.

In some embodiments, due to control of rotation of the carriage by the motor, such stops and/or the linkage may be unnecessary. In such a configuration, the controller may be configured to cause the motor to keep the carriage 240 from rotating until the cover is opened. Once the cover is opened (such as sensed by a cover opening sensor), the controller may be configured to cause the motor 248 to rotate the carriage 240 according to the arrow 201 such that carriage changes orientation to present the user with the depleted second product roll for replacement. In some embodiments, the determination of the substantial depletion of the second product roll may be a necessary condition prior to causing the carriage to rotate. In such a regard, opening the cover prior to such as determination will not cause the carriage to rotate. This may ensure that the carriage does not rotate until replacement is possible. However, in some embodiments, a carriage rotation button may be utilized to force rotation of the carriage. In some embodiments, the same motor used to control rotation of the carriage may also be used to control operation of the transfer mechanism.

In some embodiments, the opening of the cover may not be required to enable or cause rotation of the carriage. For example, rotation of the carriage may occur even while the cover is closed. Likewise, in some embodiments, opening of the cover may not automatically cause rotation of the carriage.

Some embodiments of the present invention contemplate other ways to cause the carriage to rotate. For example, FIGS. 9A-9B illustrate an example sheet product dispenser 310 with an extension arm 371 to the tucker fingers 370. As the linkage 360 moves in a similar manner to as described above, the first linkage arm 366 moves the release stop 362 out of engagement with the second carriage stop 347. Additionally, movement of the first linkage arm 366 causes movement and rotation of the second linkage arm 367 around the second linkage axis 361 and movement and rotation of the tucker lever 375 and the tucker fingers 370 around the tucker finger axis 372. Additionally, however, the extension arm 371 also moves and rotates to contact a portion (e.g., the back 349 of the second carriage stop 347) of the carriage 340 to cause rotation (such as along arrow 301). In the depicted embodiment, the carriage 340 rotates to an intermediate orientation such that the cover stop 335 interacts with the first carriage stop 343. From there, the cover may open and the carriage 340 may continue to rotate. Such continued rotation may be due to a bias (e.g., gravity, a spring, etc.) and/or continued applied force from the extension arm 371.

FIGS. 10A-10B illustrate another way to cause the carriage to rotate. In the depicted embodiment, the sheet product dispenser 410 includes a carriage 440 that is blocked from further rotation due to interaction between a cover stop 435 on the cover 430 and a carriage stop 443 on the carriage 440. The cover 430 also includes a pull flange 490 (e.g., a cover tang) that is configured to interact with the carriage 440 when the cover 430 is in the closed position. With reference to FIG. 10B, as the cover 430 opens (such as by rotating about the cover axis 431), the cover stop 435 is removed from interaction with the carriage stop 443 such that the carriage is free to rotate. Additionally, with reference to FIGS. 10A-10B, the pull flange 490 is configured to move with the cover 430 and pull the carriage 440 (such as with interaction between a pull flange engagement feature at the end 494 of the pull flange 490 and an engagement feature 495 of the carriage) to cause it to rotate (e.g., along arrow 401). As such, the pull flange 490 may be configured to cause and/or initiate rotation of the carriage 440. In this regard, the pull flange may be configured to overcome or utilize any bias to rotation of the carriage 440 (such as from gravity, springs, etc.).

In addition to or in the alternative to the above described embodiments, the sheet product dispenser and carriage may be designed to enable a user to manually rotate the carriage, such as after the cover is opened and/or after depletion of the second product roll. In such embodiments, the dispenser (such as through the controller), may be configured to enable rotation of the carriage upon the second product roll being substantially depleted. In this regard, in some embodiments, the carriage may be prevented from rotation until the second product roll is substantially depleted. For example, movement of the linkage 60 upon depletion of the second product roll may move a stop (e.g., release stop 62) to enable rotation of the carriage. In other embodiments, the controller may cause other stops or rotation prevention features to move to enable rotation of the carriage. In some such embodiments, the carriage may not be biased to automatically cause rotation—thereby requiring a user to manually cause rotation. In some embodiments, the carriage may comprise one or more handles designed to provide an access point for a user to initiate rotation of the carriage. Additionally or alternatively, a user may push a button or provide other user input that drives a motor to cause the rotation of the carriage.

As detailed herein, some embodiments of the present invention seek to provide an intuitive and easy to load sheet product dispenser. For example, in some embodiments, with reference to FIG. 11, the roll holders (e.g., roll holder 82) for the carriage 40 may define a bowl shape 80 that substantially matches the external shape of the product roll. As such, the user may intuitively load the product roll such that it fits within the bowl shape 80, which may also cause the center of the product roll to align with the roll holder slot 84 to ensure proper loading.

Additionally, in some embodiments, with reference to FIG. 12, the roll holder slot 84 may be shaped with a funnel-shaped opening such that the user can simply drop the product roll into the roll holder slot for easy installation. When dropped into the roll holder slot 84, the funnel-shape of the slot 84 may be defined such that the core 85 of the product roll (e.g., product roll 52) will follow the slope of the funnel-shape and install properly within the roll holder 82. Further, some embodiments may utilize installation guides 89 to instruct the user or draw attention to the roll holder slot 84. In the depicted embodiment, the roll holder guides 89 include arrows that lead toward the center of the roll holder slot 84, however, other guiding features are contemplated (e.g., a single arrow, LEDs, different colored LEDs, instructions, etc.).

In some embodiments, using the funnel-shaped roll holder slot 84 may cause difficulties when the carriage 40 is rotated such that the funnel-shaped roll holder slot 84 is now facing downwardly. In this regard, the product roll installed in the roll holder slot would be prone to falling out of engagement with the roll holder due to the forces of gravity. To counteract this while still enabling the easy loading features and rotation of the carriage, some embodiments of the present invention provide a retention system within the carriage that ensures that the portion of the roll holder that interacts with the core of the product roll also remains facing upwardly (i.e., even when the carriage is rotated such that the funnel-shaped roll holder slot 84 is facing downwardly). An embodiment of this concept termed a "gear system" is described with respect to FIGS. 13-14.

With reference to FIGS. 13-14, the carriage 40 of the sheet product dispenser 10 may include a gear system (e.g., a retention system) that enables easy installation of the product roll when being placed into the roll holder that is near the top of the sheet product dispenser (e.g., the roll holder slot 84 of FIG. 12 faces upwardly), but keeps an installed product roll engaged with the roll holder (e.g., roll holder 82) when the carriage 40 is in the orientation where the product roll is near the bottom of the sheet product dispenser (e.g., the roll holder slot 84 of FIG. 12 faces upside down). In this regard, the gear system may be designed to ensure that the portion of the roll holder that engages with the core of the product roll always faces generally upwardly. This enables the user to remove and install the core when the roll holder slot 84 faces upwardly, but prevents the product roll from being removed when the roll holder slot 84 faces downwardly.

The gear system may comprise a plurality of gears that work together to accomplish this feature. For example, the gear system may comprise a stationary gear, a planetary gear, and a roll holder gear. The stationary gear 95 may be positioned such that its center is aligned with the axis of rotation of the carriage 40 such that it remains "stationary" as the carriage 40 rotates. The planetary gear 96 is intermeshed with the stationary gear 95. As the carriage 40 rotates, the planetary gear 96 rotates about its axis 96' and orbits around the stationary gear 95. The roll holder gear 98 is intermeshed with the planetary gear 96. As the carriage 40 rotates, the roll holder gear 98 rotates around its axis 98' and orbits around the stationary gear 95. The roll holder gear 98 is aligned with the roll holder 82 and is designed to rotate with respect to the carriage 40 such that the portion of the roll holder 82 that interacts with the core of the product roll remains vertical as the carriage rotates. In some embodiments, the diameters of the stationary gear 95 and roll holder gear 98 are chosen to be equal such that the roll holder gear 98 remains in the same orientation with respect to the stationary gear 95. In other words, the roll holder gear 98 does not rotate about its central axis relative to the axis of rotation of the carriage, although it does translate in a circular orbit around the stationary gear 95. In this manner, the orientation of the portion of the roll holder 82 that interacts with the product roll relative to gravity does not change.

In some embodiments, with reference to FIG. 14, the roll holder 82 defines an opening 82' that is shaped to enable placement and removal of a product roll core within the roll holder 82. As the carriage 40 rotates, the structure of the carriage 40 around the opening 82' may seal the core 85 of the product roll within the roll holder 82 when the carriage is not in the loading position. For example, the carriage 40 may define a roll holder slot 84 with a roll holder guide 89 (such as defined by an upper roll holder guide 89*a* and a lower roll holder guide 89*b*). As the carriage 40 rotates downwardly, the roll holder slot 84 also rotates downwardly, however, the upward opening 82' of the roll holder 82 remains pointing generally upwards. Thus, the downward rotation of the carriage 40 causes the upper roll holder guide 89*a* to rotate over and enclose the upward opening 82' of the roll holder 82 in order to seal the core 85 of the product roll within the roll holder 82 when the carriage 40 is not in the loading position to prevent removal of the core 85 of the product roll. In this regard, the roll holder slot 84 may be designed to only enable access to remove an installed product roll when the carriage 40 is in the loading position (e.g., the first or second orientation depending on which roll holder the product roll is loaded into). This helps to further prevent the product roll from falling out during rotation of the carriage. In some embodiments, this also prevents the user from removing a product roll that is not yet substantially depleted, as the user would only be able to remove the product roll that is presented near the top of the sheet product dispenser upon opening of the cover.

Though the above described embodiments include a gear system, other systems or features are contemplated for maintaining vertical orientation of the portion of the roll holder that interacts with the core of the product roll. For example, belts, linkages, or equivalent structure can be utilized. Further, other retention system embodiments are contemplated for retaining the core of the product roll within the roll holder, such embodiments may include push-buttons, spring-loaded detents, cantilevered arm detents, etc.

To further aid in loading of sheet product into the sheet product dispenser, some embodiments contemplate providing visual instructions. For example, with reference to FIGS. 15-16, the sheet product dispenser may include a transfer mechanism that includes tucker fingers 70 that include instructions imprinted on a backplate 78. With reference to FIG. 16, the tucker fingers 70 may include one or more engagement protrusions 79 that extend toward the backplate 78 and provide friction to hold the leading edge of the product sheet in place when installed. In such example embodiments with instructions, the user will be provided with easily recognizable instructions that they can follow to properly install the leading edge of the product roll into the tucker fingers.

In some embodiments, the backplate may serve to strengthen the rigidity and provide increased durability for the tucker fingers. Such increased durability may help prevent wear and tear (and breakage) of the tucker fingers.

Example System Architecture

A schematic representation of components of an example product dispenser system 100 according to various embodiments described herein is shown in FIG. 17. It should be appreciated that the illustration in FIG. 17 is for purposes of description and that the relative size and placement of the respective components may differ. The product dispenser system 100, which includes a product dispenser 105 (e.g., a sheet product dispenser), includes components and systems that are utilized in various embodiments described herein.

The product dispenser 105 may include many different components and/or systems (such as shown in FIG. 17), including, for example, a controller 110, a dispensing mechanism 125, a carriage 140, a memory 112, a communication interface 113, a user interface 114, a power system 116, an activation sensor 120, a linkage 160, a transfer mechanism 170, one or more product sensors 118, a tear mechanism 127, and other system(s)/sensor(s) 115. Though shown in FIG. 17 as being a component of the product dispenser 105, such components are not required to be part of the product dispenser 105 according to various embodiments herein. Along these lines, the depicted embodiment of FIG. 17 is provided for explanatory purposes and is not meant to be limiting.

As will be described in more detail herein, the controller 110 provides logic and control functionality used during operation of the product dispenser 105. Alternatively, the functionality of the controller 110 may be distributed to several controllers that each provides more limited functionality to discrete portions of the operation of product dispenser 105.

The carriage 140 may be configured to hold one or more rolls of product. For example, the carriage 140 may have a first roll holder that is configured to receive the first roll of product 152 and a second roll holder that is configured to receive the second roll of product 156. As detailed herein, the carriage 140 may be rotatably connected to the housing of the product dispenser 105 and configured to rotate between various orientations. Additionally, the carriage 140 may define one or more surfaces (e.g., the first carriage stop and the second carriage stop) that are configured to interact with various other surfaces to control rotation of the carriage 140. In this regard, in some embodiments, one or more surfaces of the carriage 140 may be configured to interact with the linkage 160.

In some embodiments, the carriage 140 may include a motor 148 configured to cause and/or control rotation of the carriage 140. The carriage motor 148 may be in communication with and controlled by the controller 110.

The activation sensor 120 may be configured to sense/receive user input (such as a user's hand or portion thereof) indicating a desire to cause the product dispenser 105 to dispense a portion of product (e.g., a portion of sheet from the first or second product roll). The activation sensor 120 may be any type of sensor or feature capable of receiving user input to begin dispensing, including for example, a capacitive sensor, a light sensor, an IR sensor, a mechanical lever or button, etc. The activation sensor 120 may be in communication with the controller 110 such that the controller 110 can determine when to cause dispensing of the product.

The dispensing mechanism 125 may be configured to cause dispensing of a portion of the product, such as a portion (or length) of the roll of product (e.g., the first or second product roll). Depending on the configuration, the dispensing mechanism 125 may comprise a motor 126 that drives one or more drive rollers (e.g., rollers 128). A portion of the product roll may be sandwiched (e.g., in frictional contact) between the drive roller and one or more pinch rollers such that operation/rotation of the drive roller causes dispensing of a portion of the product roll. The dispensing mechanism motor 126 may be in communication with the controller 110 such that the controller 110 may control operation of the motor 126.

The tear mechanism 127 may be configured to enable tearing of the dispensed portion of the product roll. In this regard, the tear mechanism 127 may comprise a tear bar or other feature that can enable a user to provide a force to tear off the portion of the product roll. For example, the tear mechanism 127 may include a serrated edge that cuts into the sheet when the user pulls the dispensed product. The separated portion of the product from the product roll may then be used and discarded as necessary by the user. Alternatively, the tear mechanism 127 may be configured to perform a tear or partial tear prior to interaction with the user such that user simply pulls on the pre-torn portion of the product roll to complete dispensing of the portion of the product.

The transfer mechanism 170 may be configured to cause transfer of the leading edge of a product roll into the dispensing mechanism 125 to enable dispensing from that product roll. The transfer mechanism 170 may be any feature or component capable of performing the transfer, such as one or more tucker fingers described herein (though other components such as transfer rollers are contemplated). In this regard, upon substantial depletion of one of the product rolls, the transfer mechanism 170 may be activated to move the leading edge of the remaining product roll into the dispensing mechanism 125 (e.g., the nip between the drive roller and pinch roller) to transfer dispensing to that remaining product roll. This avoids an empty scenario and allows continuous dispensing of product to occur between product rolls. Though the transfer mechanism 170 is shown as interacting with the first product roll 152, in some embodiments the transfer mechanism 170 may interact with the second product roll 156 (such as when the first product roll 152 is being dispensed from).

The linkage 160, such as described in various embodiments herein, may be configured to interact with the carriage 140 and/or the transfer mechanism 170 and may be controlled by the controller 110. In some embodiments, the linkage 160 may define a release stop that may be moved by the controller 110 (such as through a separate motor) to be removed from interaction with a portion of the carriage 140 to enable the carriage 140 to rotate. In some embodiments, the linkage 160 may be connected to the transfer mechanism 170 and be moved by the controller 110 (such as through a separate motor) to cause the transfer mechanism 170 to transfer the leading edge of a product roll into the dispensing mechanism 125. In some embodiments, the linkage 160 may be operated to perform both such functions substantially simultaneously.

The product sensor 118 is configured to sense product data. In some embodiments, the product data may correspond to dispensing from at least one of the first product roll or the second product roll (e.g., how much product is being dispensed, when product is being dispensed, which product roll is dispensing occurring from, etc.). Additionally or alternatively, the product data may correspond to an amount of product remaining for at least one of the first product roll or the second product roll (e.g., a remaining size of the product roll, an amount of the product roll remaining, etc.). The product sensor 118 may be in communication with the controller 110 such that the controller 110 may receive the product data and perform one or more determinations regarding the product data (e.g., if one or more of the product rolls are substantially depleted, which product roll is dispensing, if there is leftover product in an exit chute, if a successful transfer occurred, the orientation of the carriage, if there is a product jam, among others). Depending on the configuration of the product dispenser 105 and/or the desired information/product data, one or more product sensors 118 may be configured to sense data from the first product roll 152, the second product roll 156, the transfer mechanism 170, the dispensing mechanism 125, the tear mechanism 127, and/or other components of the product dispenser 105 (e.g., a dispensing slot, etc.).

The controller 110 is a suitable electronic device capable of executing dispenser functionality via hardware and/or software control, with the preferred embodiment accepting data and instructions, executing the instructions to process the data, and presenting the results. Controller 110 may accept instructions through the user interface 114, or through other means such as but not limited to the activation sensor 120, other sensors, voice activation means, manually-operable selection and control means, radiated wavelength and electronic or electrical transfer. Therefore, the controller 110 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 110 may be operably coupled with one or more components of the product dispenser 105. Such operable coupling may include, but is not limited to, solid-core wiring, twisted pair wiring, coaxial cable, fiber optic cable, mechanical, wireless, radio, and infrared. Controller 110 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 110 may include one or more processors coupled to a memory device 112. Controller 110 may optionally be connected to one or more input/output (I/O) controllers or data interface devices (not shown). The memory 112 may be any form of memory such as an EPROM (Erasable Programmable Read Only Memory) chip, a flash memory chip, a disk drive, or the like. As such, the memory 112 may store various data, protocols, instructions, computer program code, operational parameters, etc. In this regard, controller 110 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 110 may be configured to execute computer program code instructions to perform aspects of various embodiments of the present invention described herein. For example, the controller 110 may be configured to determine an instance in which one of the product rolls is substantially depleted. In such a regard, in some embodiments, the controller 110 may be configured to operate one or more components of the product dispenser 105 to enable rotation of the carriage—such as described in various example embodiments herein.

The user interface 114 may be configured to provide information and/or indications to a user. In some embodiments, the user interface 114 may comprise one or more light emitting diodes (LEDs) to indicate such information (e.g., low battery, dispensing is occurring, low product amount, transfer complete, etc.). In some embodiments, the user interface 114 may include a screen to display such information. In some embodiments, the user interface 114 may be configured to receive user input such as through a keypad, touchscreen, buttons, or other input device. The user interface 114 may be in communication with the controller 110 such that the controller 110 can operate the user interface 114 and/or receive instructions or information from the user interface 114.

The communication interface 113 may be configured to enable connection to external systems (e.g., an external network 102). In this manner, the controller 110 may retrieve data and/or instructions from or transmit data and/or instructions to a remote, external server via the external network 102 in addition to or as an alternative to the memory 112.

In an example embodiment, the electrical energy (e.g., power 116) for operating the product dispenser 105 may be provided by a battery, which may be comprised of one or more batteries arranged in series or in parallel to provide the desired energy. For example, the battery may comprise four 1.5-volt "D" cell batteries. Additionally or alternatively, the power 116 may be supplied by an external power source, such as an alternating current ("AC") power source or a solar power source, or any other alternative power source as may be appropriate for an application. The AC power source may be any conventional power source, such as a 120V, 60 Hz wall outlets for example.

The other sensor(s)/system(s) 115 may be any other type of sensors or systems that are usable in various embodiments of the present invention. Some example additional sensors or systems include a position sensor, a time sensor, a cover opening or closing sensor, among many others.

As indicated herein, some embodiments of the present invention may be utilized with other types of product dispensers (such as mechanical product dispensers). Additional information regarding non-automated (mechanical) product dispensers, including components and functionality thereof, can be found in U.S. Pat. Nos. 7,270,292 and 5,441,189, both of which are assigned to the owner of the present invention and incorporated by reference in their entireties.

Example Flowchart(s)

Embodiments of the present invention provide methods, apparatuses and computer program products for controlling and operating product dispensers according to various embodiments described herein. Various examples of the operations performed in accordance with embodiments of the present invention will now be provided with reference to FIGS. 18-19.

FIG. 18 illustrates a flowchart according to an example method for controlling operation of a product dispenser according to an example embodiment 500. The operations illustrated in and described with respect to FIG. 18 may, for example, be performed by, with the assistance of, and/or under the control of one or more of the controller 110, memory 112, communication interface 113, product sensor 118, linkage 160, carriage 140, dispensing mechanism 125, and/or transfer mechanism 170 of the product dispenser 105.

Operation 502 may comprise determining an instance in which the second roll of product is substantially depleted. The controller 110, memory 122, communication interface 113, carriage 140, and/or product sensor 118 may, for example, provide means for performing operation 502. Operation 504 may comprise removing a release stop from interaction with the carriage to enable rotation of the carriage. The controller 110, linkage 160, and/or carriage 140 may, for example, provide means for performing operation 504. Operation 506 may comprise causing transfer of the leading edge of the first roll of product to the dispensing mechanism. The controller 110, linkage 160, dispensing mechanism 125, transfer mechanism 170, and/or carriage 140 may, for example, provide means for performing operation 506.

FIG. 19 illustrates a flowchart according to another example method for controlling operation of a product dispenser according to an example embodiment 600. The operations illustrated in and described with respect to FIG. 19 may, for example, be performed by, with the assistance of, and/or under the control of one or more of the controller 110, memory 112, communication interface 113, product sensor 118, linkage 160, carriage 140, dispensing mechanism 125, transfer mechanism 170, carriage motor 148, and/or other sensor(s)/system(s) of the product dispenser 105.

Operation 602 may comprise determining an instance in which the second roll of product is substantially depleted. The controller 110, memory 122, communication interface 113, carriage 140, and/or product sensor 118 may, for example, provide means for performing operation 602. Operation 604 may comprise causing transfer of the leading edge of the first roll of product to the dispensing mechanism. The controller 110, linkage 160, dispensing mechanism 125, transfer mechanism 170, and/or carriage 140 may, for example, provide means for performing operation 604. Operation 606 may comprise determining that the cover has been opened. The controller 110 and/or other sensor(s)/system(s) 115 may, for example, provide means for performing operation 606. Operation 608 may comprise causing rotation of the carriage. The controller 110, linkage 160, and/or carriage 140 (e.g., through a carriage motor 148) may, for example, provide means for performing operation 608.

FIGS. 18-19 illustrate flowcharts of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 112 and executed by, for example, the controller 110. As will be appreciated, any such computer program product may be loaded onto a computer or other programmable apparatus, such that the computer program product including the instructions which execute on the computer or other programmable apparatus creates means for implementing the functions specified in the flowcharts block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowcharts block(s).

Associated systems and methods for manufacturing example product dispensers described herein are also contemplated by some embodiments of the present invention.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A product dispenser comprising:

a housing including a base portion and a cover, wherein the cover is movable relative to the base portion to define an open position and a closed position, wherein the base portion extends in a first plane;

a carriage rotatably coupled to the base portion, wherein the carriage defines a first end and a second end, wherein the carriage is rotatable between at least a first orientation and a second orientation, wherein the carriage comprises:

a first roll holder positioned proximate to the first end of the carriage, wherein the first roll holder is configured to receive a first roll of product and enable rotation of the first roll of product about a first axis, wherein the first axis is parallel to the first plane; and a second roll holder positioned proximate to the second end of the carriage, wherein the second roll holder is configured to receive a second roll of product;

a dispensing mechanism configured to receive a leading edge of one of the first roll of product or the second roll of product and cause dispensing of a portion of the corresponding first roll of product or the second roll of product;

a product sensor configured to sense product data corresponding to at least one of:

dispensing from at least one of the first roll of product or the second roll of product; or an amount of product remaining for at least one of the first roll of product or the second roll of product; and a controller configured to:

determine, based on the product data from the product sensor, an instance in which the second roll of product is at least substantially depleted; and enable rotation of the carriage in an instance in which the second roll of product is at least substantially depleted so as to provide a user access to the second roll holder to enable replacement of the at least substantially depleted second roll of product.

2. The product dispenser of claim 1, wherein the controller is further configured to, in response to determining an instance in which the second roll of product is at least substantially depleted, cause rotation of the carriage to an intermediate orientation between the first orientation and second orientation.

3. The product dispenser of claim 2, wherein the carriage is biased to rotate from the intermediate orientation to the second orientation, wherein the cover comprises at least one cover stop that is configured to interact with at least a portion of the carriage when the cover is in the closed position and the carriage has rotated to the intermediate orientation, wherein the cover stop prevents further rotation of the carriage toward the second orientation, and wherein, in an instance in which a user opens the cover, the cover stop is removed from interaction with the portion of the carriage to cause the carriage to automatically rotate to the second orientation.

4. The product dispenser of claim 3, wherein the carriage comprises a first stop positioned proximate the first end and a second stop positioned proximate the second end, wherein the product dispenser further comprises a release stop that is configured to interact with the second stop of the carriage when the carriage is in the first orientation, wherein the controller is configured to, in response to determining an instance in which the second roll of product is at least substantially depleted, cause the release stop to be removed from interaction with the second stop of the carriage to cause rotation of the carriage to the intermediate orientation, and wherein the first stop of the carriage is configured to interact with the cover stop when the carriage is in the intermediate orientation.

5. The product dispenser of claim 2 further comprising a linkage that defines a release stop and is connected to a transfer mechanism, wherein the release stop is configured to interact with at least a portion of the carriage to prevent rotation of the carriage from the first orientation to the intermediate orientation, wherein the transfer mechanism is configured to transfer the leading edge of the first roll of product to the dispensing mechanism to enable dispensing from the first roll of product, and wherein the controller is configured to, in response to determining an instance in which the second roll of product is at least substantially depleted, simultaneously cause, via movement of the linkage, the release stop to be removed from interaction with the portion of the carriage to cause rotation of the carriage to the intermediate orientation and the transfer mechanism to transfer the leading edge of the first roll of product to the dispensing mechanism.

6. The product dispenser of claim 2 further comprising a transfer mechanism, wherein the transfer mechanism is configured to transfer the leading edge of the first roll of product to the dispensing mechanism to enable dispensing from the first roll of product, wherein the transfer mechanism defines a backplate that includes visual instructions for attaching a leading edge of a roll of product to the transfer mechanism.

7. The product dispenser of claim 2 further comprising a transfer mechanism defining an extension portion, wherein the transfer mechanism is configured to transfer the leading edge of the first roll of product to the dispensing mechanism to enable dispensing from the first roll of product, and wherein the controller is configured to, in response to determining an instance in which the second roll of product is at least substantially depleted, simultaneously cause the transfer mechanism to transfer the leading edge of the first roll of product to the dispensing mechanism and the extension portion to engage the carriage to cause rotation of the carriage from the first orientation to the intermediate orientation.

8. The product dispenser of claim 1, wherein the carriage is biased by at least one of gravity or one or more biasing elements to rotate from the first orientation to the second orientation.

9. The product dispenser of claim 1, wherein the cover defines a pull flange that is configured to pull at least a portion of the carriage as the cover opens to cause rotation of the carriage.

10. The product dispenser of claim 1 further comprising at least one motor configured to cause rotation of the carriage, wherein the controller is configured to, in an instance in which the carriage is in the first orientation and the second roll of product is at least substantially depleted, cause the motor to automatically rotate the carriage when the cover is moved to the open position.

11. The product dispenser of claim 1, wherein, when the cover is in the closed position, the housing and the carriage are each sized such that both of the first roll holder and the second roll holder are configured to each hold a full size roll of product.

12. The product dispenser of claim 1, wherein the second roll holder defines a bowl shape section that corresponds to the shape of the new roll of product to enable intuitive installation of the new roll of product.

13. The product dispenser of claim 1, wherein the second roll holder defines a roll holder slot, wherein the roll holder slot is shaped to enable a user to drop a new roll of product into the roll holder slot for easy installation of the new roll of product.

14. The product dispenser of claim 13, wherein the roll holder slot of the second roll holder includes one or more installation guides to provide instruction to the user regarding how to install the new roll of product into the second roll holder.

15. The product dispenser of claim 13, wherein the carriage defines a carriage axis of rotation and comprises:

a stationary gear with a center aligned with the carriage axis of rotation;

a planetary gear that interacts with and rotates around the stationary gear as the carriage rotates, wherein the planetary gear includes a planetary gear center axis that is disposed outwardly from the carriage axis of rotation; and a roll holder gear that interacts with the planetary gear as the carriage rotates, wherein the roll holder gear includes a roll holder gear center axis that is disposed outwardly from the planetary gear center axis with respect to the carriage axis of rotation, wherein the roll holder gear center axis is aligned with an axis of rotation for the second roll holder, and wherein, as the carriage rotates from the second orientation to the first orientation, the roll holder slot for the second roll holder remains oriented generally vertically to prevent the roll of product in the second roll holder from dropping out of the second roll holder.

16. The product dispenser of claim 1, wherein, when the carriage is in an intermediate orientation between the first orientation and the second orientation and the second roll of product is at least substantially depleted, the carriage is configured to automatically rotate to the second orientation upon moving the cover from the closed position toward the open position.

17. The product dispenser of claim 1, wherein, when the carriage is in the first orientation, the first roll holder is positioned generally vertically above the second roll holder, wherein, when the carriage is in the second orientation, the second roll holder is positioned generally vertically above the first roll holder.

18. A method of operating a product dispenser, the method comprising:

operating a dispensing mechanism of the product dispenser to cause dispensing of a portion of at least one of a first roll of product or a second roll of product stored in the product dispenser, wherein the product dispenser comprises:

a housing including a base portion and a cover, wherein the cover is movable relative to the base portion to define an open position and a closed position;

a carriage rotatably coupled to the base portion, wherein the carriage defines a first end and a second end, wherein the carriage is rotatable between at least a first orientation and a second orientation, wherein the carriage comprises:

a first roll holder positioned proximate to the first end of the carriage, wherein the first roll holder is configured to receive the first roll of product; and a second roll holder positioned proximate to the second end of the carriage, wherein the second roll holder is configured to receive the second roll of product;

the dispensing mechanism, wherein the dispensing mechanism is configured to receive a leading edge of one of the first roll of product or the second roll of product and cause dispensing of a portion of the corresponding first roll of product or the second roll of product;

a product sensor configured to sense product data corresponding to at least one of the first roll of product or the second roll of product; and a controller;

determining, based on the product data from the product sensor, an instance in which the second roll of product is at least substantially depleted; and causing automatic rotation of the carriage to one of the second orientation or an intermediate orientation between the first orientation and the second orientation upon determining that the second roll of product is at least substantially depleted.

19. The method of claim 18 further comprising causing, in an instance in which the carriage is in the first orientation and the second roll of product is determined to be at least substantially depleted, rotation of the carriage from the first orientation to an intermediate orientation between the first orientation and the second orientation.

20. The method of claim 19, wherein the product dispenser further comprises a linkage that defines a release stop and is connected to a transfer mechanism, wherein the release stop is configured to interact with at least a portion of the carriage to prevent rotation of the carriage from the first orientation to the intermediate orientation, wherein the transfer mechanism is configured to transfer the leading edge of the first roll of product to the dispensing mechanism to enable dispensing from the first roll of product, wherein the method further comprises simultaneously causing, in response to determining an instance in which the second roll of product is at least substantially depleted and via movement of the linkage, the release stop to be removed from interaction with the portion of the carriage to cause rotation of the carriage to the intermediate orientation and the transfer mechanism to transfer the leading edge of the first roll of product to the dispensing mechanism.

21. A product dispenser comprising:

a housing including a base portion and a cover, wherein the cover is movable relative to the base portion to define an open position and a closed position;

a carriage rotatably coupled to the base portion, wherein the carriage defines a first end and a second end, wherein the carriage is rotatable between at least a first orientation and a second orientation, wherein the carriage comprises:

a first roll holder positioned proximate to the first end of the carriage, wherein the first roll holder is configured to receive a first roll of product; and a second roll holder positioned proximate to the second end of the carriage, wherein the second roll holder is configured to receive a second roll of product;

a dispensing mechanism configured to receive a leading edge of one of the first roll of product or the second roll of product and cause dispensing of a portion of the corresponding first roll of product or the second roll of product;

a product sensor configured to sense product data corresponding to at least one of the first roll of product or the second roll of product; and a controller configured to:

determine, based on the product data from the product sensor, an instance in which the second roll of product is at least substantially depleted; and cause, in an instance in which the carriage is in the first orientation and the second roll of product is determined to be at least substantially depleted, rotation of the carriage from the first orientation to an intermediate orientation between the first orientation and the second orientation, wherein, in an instance in which the carriage is in the intermediate orientation, the carriage is configured to automatically rotate from the intermediate orientation to the second orientation upon moving the cover from the closed position toward the open position so as to provide a user access to the second roll holder to enable replacement of the at least substantially depleted second roll of product.

22. A product dispenser comprising:

a housing including a base portion and a cover, wherein the cover is movable relative to the base portion to define an open position and a closed position, wherein the base portion extends in a first plane;

a carriage rotatably coupled to the base portion, wherein the carriage defines a first end and a second end, wherein the carriage is rotatable about a first axis between at least a first orientation and a second orientation, wherein the first axis is parallel to the first plane, wherein the carriage comprises:

a first roll holder positioned proximate to the first end of the carriage, wherein the first roll holder is configured to receive a first roll of product; and a second roll holder positioned proximate to the second end of the carriage, wherein the second roll holder is configured to receive a second roll of product;

a dispensing mechanism configured to receive a leading edge of one of the first roll of product or the second roll of product and cause dispensing of a portion of the corresponding first roll of product or the second roll of product;

a linkage that defines a release stop, wherein the release stop is configured to interact with at least a portion of the carriage to prevent rotation of the carriage; and a sensor configured to sense that the second roll of product is at least substantially depleted, wherein the sensor is configured to cause, in response to sensing that the second roll of product is at least substantially depleted, the linkage to disengage the release stop from the carriage to enable rotation of the carriage to the second orientation so as to provide a user access to the second roll holder to enable replacement of the at least substantially depleted second roll of product.

23. The product dispenser of claim 22, wherein the linkage is connected to a transfer mechanism, wherein the transfer mechanism is configured to transfer the leading edge of the first roll of product to the dispensing mechanism to enable dispensing from the first roll of product, and wherein the sensor is further configured to, in response to sensing that the second roll of product is at least substantially depleted, cause the linkage to cause the transfer mechanism to transfer the leading edge of the first roll of product to the dispensing mechanism.

24. A product dispenser comprising:

a housing including a base portion and a cover, wherein the cover is movable relative to the base portion to define an open position and a closed position, wherein the base portion extends in a first plane;

a carriage rotatably coupled to the base portion, wherein the carriage defines a first end and a second end, wherein the carriage is rotatable between at least a first orientation and a second orientation, wherein the carriage comprises:

a first roll holder positioned proximate to the first end of the carriage, wherein the first roll holder is configured to receive a first roll of product and enable rotation of the first roll of product about a first axis, wherein the first axis is parallel to the first plane; and a second roll holder positioned proximate to the second end of the carriage, wherein the second roll holder is configured to receive a second roll of product;

a dispensing mechanism configured to receive a leading edge of one of the first roll of product or the second roll of product and cause dispensing of a portion of the corresponding first roll of product or the second roll of product;

a controller; and at least one motor configured to cause rotation of the carriage, wherein the controller is configured to, in an instance in which the carriage is in the first orientation and the second roll of product is at least substantially depleted, cause the motor to automatically rotate the carriage when the cover is moved to the open position so as to provide a user access to the second roll holder to enable replacement of the at least substantially depleted second roll of product.

25. A product dispenser comprising:

a housing including a base portion and a cover, wherein the cover is movable relative to the base portion to define an open position and a closed position, wherein the base portion extends in a first plane;

a carriage rotatably coupled to the base portion, wherein the carriage defines a first end and a second end, wherein the carriage is rotatable between at least a first orientation and a second orientation, wherein the carriage defines a carriage axis of rotation and comprises:

a first roll holder positioned proximate to the first end of the carriage, wherein the first roll holder is configured to receive a first roll of product and enable rotation of the first roll of product about a first axis, wherein the first axis is parallel to the first plane;

a second roll holder positioned proximate to the second end of the carriage, wherein the second roll holder is configured to receive a second roll of product, wherein the second roll holder defines a roll holder slot, wherein the roll holder slot is shaped to enable a user to drop a new roll of product into the roll holder slot for easy installation of the new roll of product;

a stationary gear with a center aligned with the carriage axis of rotation;

a planetary gear that interacts with and rotates around the stationary gear as the carriage rotates, wherein the planetary gear includes a planetary gear center axis that is disposed outwardly from the carriage axis of rotation; and a roll holder gear that interacts with the planetary gear as the carriage rotates, wherein the roll holder gear includes a roll holder gear center axis that is disposed outwardly from the planetary gear center axis with respect to the carriage axis of rotation, wherein the roll holder gear center axis is aligned with an axis of rotation for the second roll holder, and wherein, as the carriage rotates from the second orientation to the first orientation, the roll holder slot for the second roll holder remains oriented generally vertically to prevent the roll of product in the second roll holder from dropping out of the second roll holder; and a dispensing mechanism configured to receive a leading edge of one of the first roll of product or the second roll of product and cause dispensing of a portion of the corresponding first roll of product or the second roll of product, wherein, in an instance in which the second roll of product is at least substantially depleted, the carriage is configured to automatically rotate to the second orientation so as to provide a user access to the second roll holder to enable replacement of the at least substantially depleted second roll of product.

* * * * *